US008943948B2

(12) United States Patent
Kuczynko et al.

(10) Patent No.: US 8,943,948 B2
(45) **Date of Patent: *Feb. 3, 2015**

(54) FIREARM HAVING AN INDIRECT GAS OPERATING SYSTEM

(75) Inventors: Grzegorz Kuczynko, Unionville, CT (US); Josh Dorsey, Columbia, CT (US)

(73) Assignee: Colt's Manufacturing Company LLC, West Hartford, CT (US)

( * ) Notice: Subject to any disclaimer, the term of this patent is extended or adjusted under 35 U.S.C. 154(b) by 149 days.

This patent is subject to a terminal disclaimer.

(21) Appl. No.: 13/100,084

(22) Filed: May 3, 2011

(65) Prior Publication Data

US 2011/0265640 A1 Nov. 3, 2011

Related U.S. Application Data

(63) Continuation of application No. 12/610,854, filed on Nov. 2, 2009, now Pat. No. 7,934,447, which is a continuation of application No. 11/231,063, filed on Sep. 19, 2005, now Pat. No. 7,610,844.

(60) Provisional application No. 60/610,703, filed on Sep. 17, 2004.

(51) Int. Cl.
*F41A 5/18* (2006.01)
*F41A 5/28* (2006.01)

(52) U.S. Cl.
CPC ..... *F41A 5/28* (2013.01)
USPC ..... 89/193

(58) Field of Classification Search
USPC ..... 89/191.01–193; 42/72, 75.01, 96, 111
See application file for complete search history.

(56) References Cited

U.S. PATENT DOCUMENTS

| | | | | |
|---|---|---|---|---|
| 878,857 | A | 2/1908 | Bevier | |
| 1,501,446 | A * | 7/1924 | French | 42/148 |
| 2,276,446 | A | 3/1942 | Zimmerman | |
| 2,331,903 | A | 10/1943 | Garand | |
| 2,457,835 | A | 1/1949 | Schiff | |
| 2,462,119 | A | 2/1949 | Moore | |
| 2,715,858 | A * | 8/1955 | Hoppert | 89/193 |
| 2,771,819 | A | 11/1956 | Morse et al. | |

(Continued)

FOREIGN PATENT DOCUMENTS

| | | |
|---|---|---|
| CH | 631 542 A5 | 8/1982 |
| WO | 2007014770 A1 | 2/2007 |

(Continued)

OTHER PUBLICATIONS

Supplemental European Search Report dated Oct. 25, 2011 for Application No. 05858155.4-1260/ 1797389.

(Continued)

*Primary Examiner* — Bret Hayes
(74) *Attorney, Agent, or Firm* — Cantor Colburn LLP

(57) ABSTRACT

An automatic or semi-automatic firearm having an indirect gas operating system, the firearm having: a receiver; a bolt assembly slidably received within the receiver; a barrel having a bore, the barrel coupled to the receiver; a gas block mounted to the barrel, the gas block having a cylinder in fluid communication with the bore; a rod coupled to the cylinder and having a striking rod; wherein gas discharged from a fired cartridge displaces the rod and causes the striking rod to strike a striking surface of the bolt assembly, wherein the gas repositions the bolt assembly in bore.

21 Claims, 33 Drawing Sheets

(56) References Cited

U.S. PATENT DOCUMENTS

| | | | | |
|---|---|---|---|---|
| 3,246,567 | A | 4/1966 | Miller | |
| 3,568,324 | A | 3/1971 | Jorczak | |
| 3,592,101 | A | 7/1971 | Vartanian et al. | |
| 3,618,457 | A | 11/1971 | Miller | |
| 3,709,092 | A | 1/1973 | Tazome | |
| 3,810,412 | A | 5/1974 | Zamacola | |
| 3,945,296 | A | 3/1976 | Hyytinen | |
| 4,174,654 | A | 11/1979 | Liedke | |
| 4,244,273 | A | 1/1981 | Langendorfer, Jr. et al. | |
| 4,269,109 | A | 5/1981 | Stoner | |
| D266,783 | S | 11/1982 | Stratman | |
| 4,433,610 | A | 2/1984 | Tatro | |
| 4,433,611 | A | 2/1984 | Baumann | |
| 4,658,702 | A | 4/1987 | Tatro | |
| 4,691,442 | A | 9/1987 | Center | |
| 5,272,956 | A | 12/1993 | Hudson | |
| 5,351,598 | A | 10/1994 | Schuetz | |
| 5,726,377 | A | 3/1998 | Harris et al. | |
| 5,760,328 | A | 6/1998 | Robbins | |
| 5,824,943 | A | 10/1998 | Guhring et al. | |
| 6,606,813 | B1 | 8/2003 | Squire et al. | |
| 6,634,274 | B1 * | 10/2003 | Herring | 89/33.14 |
| 6,732,467 | B1 | 5/2004 | Luth | |
| 6,779,288 | B1 | 8/2004 | Kim | |
| 6,779,290 | B1 | 8/2004 | Houtsma | |
| 6,848,351 | B1 | 2/2005 | Davies | |
| 7,213,498 | B1 | 5/2007 | Davies | |
| 7,418,898 | B1 | 9/2008 | Desomma | |
| 7,461,581 | B2 | 12/2008 | Leitner-Wise | |
| 7,469,624 | B1 | 12/2008 | Adams | |
| 7,596,900 | B2 | 10/2009 | Robinson et al. | |
| 7,610,844 | B2 * | 11/2009 | Kuczynko et al. | 89/193 |
| 7,637,199 | B2 | 12/2009 | Fluhr et al. | |
| 7,739,939 | B2 | 6/2010 | Adams | |
| 7,779,743 | B2 | 8/2010 | Herring | |
| 7,934,447 | B2 * | 5/2011 | Kuczynko et al. | 89/193 |
| 2005/0115398 | A1 | 6/2005 | Olson | |
| 2005/0241470 | A1 | 11/2005 | Hochstrate et al. | |
| 2005/0262752 | A1 | 12/2005 | Robinson et al. | |
| 2007/0006509 | A1 * | 1/2007 | DeSomma et al. | 42/72 |
| 2009/0000173 | A1 | 1/2009 | Robinson et al. | |
| 2009/0007477 | A1 | 1/2009 | Robinson et al. | |
| 2009/0031606 | A1 | 2/2009 | Robinson et al. | |
| 2009/0031607 | A1 | 2/2009 | Robinson et al. | |
| 2010/0000400 | A1 | 1/2010 | Brown | |
| 2010/0101405 | A1 | 4/2010 | Adams | |
| 2010/0186582 | A1 | 7/2010 | Juarez | |
| 2010/0199836 | A1 | 8/2010 | Herring | |
| 2010/0218671 | A1 | 9/2010 | Mayberry et al. | |
| 2010/0269682 | A1 | 10/2010 | Vuksanovich et al. | |

FOREIGN PATENT DOCUMENTS

| | | | |
|---|---|---|---|
| WO | 2008140833 | A2 | 11/2008 |
| WO | 2010111026 | A1 | 9/2010 |
| WO | 2010111109 | A1 | 9/2010 |

OTHER PUBLICATIONS

Barrett, REC-7 Manual, http://www.barrett.net.pdfs/Manual-REC-7.pdf, Sep. 1, 2011.

Bushmaster Firearms, Bushmaster Owner's Manual, http://www.bushmaster.com/electronic-documents/ACR-owners-manual.pdf, Sep. 1, 2011.

Para Ordance, Tactical Target Rifle Specifications, http://www.paraord.com/new/product_rifle.php#specs, Sep. 1, 2011.

ZM Weapons Safety and Instruction Manual, http://www.ar15.com/content/manuals/lr300.pdf, Sep. 1, 2011.

NRA Staff, American Rifleman, Para USA Tactical Target Rifle, http://www.americanrifleman.org/ArticlePage.aspx?id=2070&cid=4, Sep. 1, 2011.

Para Ordnance 2010 Catalog.

Remington Defense, RGP Brochure, http://www.remingtonmilitary.com/Firearms/Carbines/RGP.aspx, Sep. 1, 2011.

Smith & Wesson, M&P 15 Rifle Manual, http://www.smith-wesson.com/wcsstore/SmWesson2/upload/other/S&W_M&P15_Rifle_Manual.pdf, Sep. 1, 2011.

* cited by examiner

FIREARM HAVING AN INDIRECT GAS OPERATING SYSTEM

CROSS-REFERENCE TO RELATED APPLICATIONS

This application is a continuation of U.S. patent application Ser. No. 12/610,854, filed Nov. 2, 2009, which is a continuation of U.S. patent application Ser. No. 11/231,063, filed Sep. 19, 2005, now U.S. Pat. No. 7,610,844 which claims the benefit of Provisional Application No. 60/610,703, filed Sep. 17, 2004 the contents each of which are incorporated herein by reference thereto.

BACKGROUND

The disclosed embodiments relate to firearms and, more particularly, to a firearm having an indirect gas operating system.

Combat firearms employ various methods to eject spent and reload unfired cartridges in semi automatic or automatic operation. Such methods may employ gas resulting from a discharged cartridge whereby the bolt assembly is displaced by action of the gas. A problem arises when a user deploys such a system where the firing rate is fixed resulting in either and excessive rate of cartridge consumption or insufficient firing rate.

Accordingly, there is a desire to provide a variable firing rate semi automatic or automatic firearm.

SUMMARY OF THE INVENTION

In accordance with one exemplary embodiment, an automatic or semi-automatic firearm having an indirect gas operating system is provided. The firearm having: a receiver; a bolt assembly slidably received within the receiver; a barrel having a bore, the barrel coupled to the receiver; a gas block mounted to the barrel, the gas block having a cylinder in fluid communication with the bore; a rod coupled to the cylinder and having a striking rod; wherein gas discharged from a fired cartridge displaces the rod and causes the striking rod to strike a striking surface of the bolt assembly, wherein the gas repositions the bolt assembly in bore.

In accordance with another exemplary embodiment, an automatic or semi-automatic firearm having an indirect gas operating system is provided. The firearm having: a receiver; a bolt assembly slidably received within the receiver; a barrel having a bore, the barrel being coupled to the receiver; a front sight frame having an integral cylinder, the front sight frame secured to barrel wherein the integral cylinder is in fluid communication with the bore; a front folding sight movably coupled to the front sight frame; and a piston assembly having a piston end and a striking end, the piston slidably received within the cylinder; wherein gas discharged from a fired cartridge displaces the piston with the cylinder and causes the striking end to contact and move the bolt assembly within the receiver.

In accordance with another exemplary embodiment, an automatic or semi-automatic firearm having an indirect gas operating system is provided. The firearm having: a receiver; a bolt assembly slidably received within the receiver; a barrel having a bore, the barrel coupled to the receiver; a hand guard assembly coupled to the receiver and surrounding at least a portion of the barrel; a plurality of accessory rails removably secured to the hand guard assembly; a gas block fitted to the barrel; and a rod assembly; wherein gas discharged from a fired cartridge displaces the rod assembly and causes a striking rod of the rod assembly to strike and displace the bolt assembly.

In accordance with yet another exemplary embodiment, an automatic or semi-automatic firearm having an indirect gas operating system is provided. The firearm having: a bolt assembly having a striking surface, the bolt assembly slidably received within a receiver; a barrel having a bore, the barrel coupled to the receiver; a gas block having a cylinder, the gas block secured to the barrel, wherein the cylinder is in fluid communication with the bore; and an operating rod assembly having a piston interface end and a striking end, the piston interface end being actuably coupled to the cylinder; wherein, gas discharged from a fired cartridge pressurizes the cylinder displacing the piston interface end and causes the striking end to strike the striking surface displacing the bolt assembly, and wherein the striking end and the striking surface disengage each other after the striking end strikes the striking surface.

BRIEF DESCRIPTION OF THE DRAWINGS

Other features, advantages and details appear, by way of example only, in the following description of embodiments, the description referring to the drawings in which.

DETAILED DESCRIPTION

Figure 1:
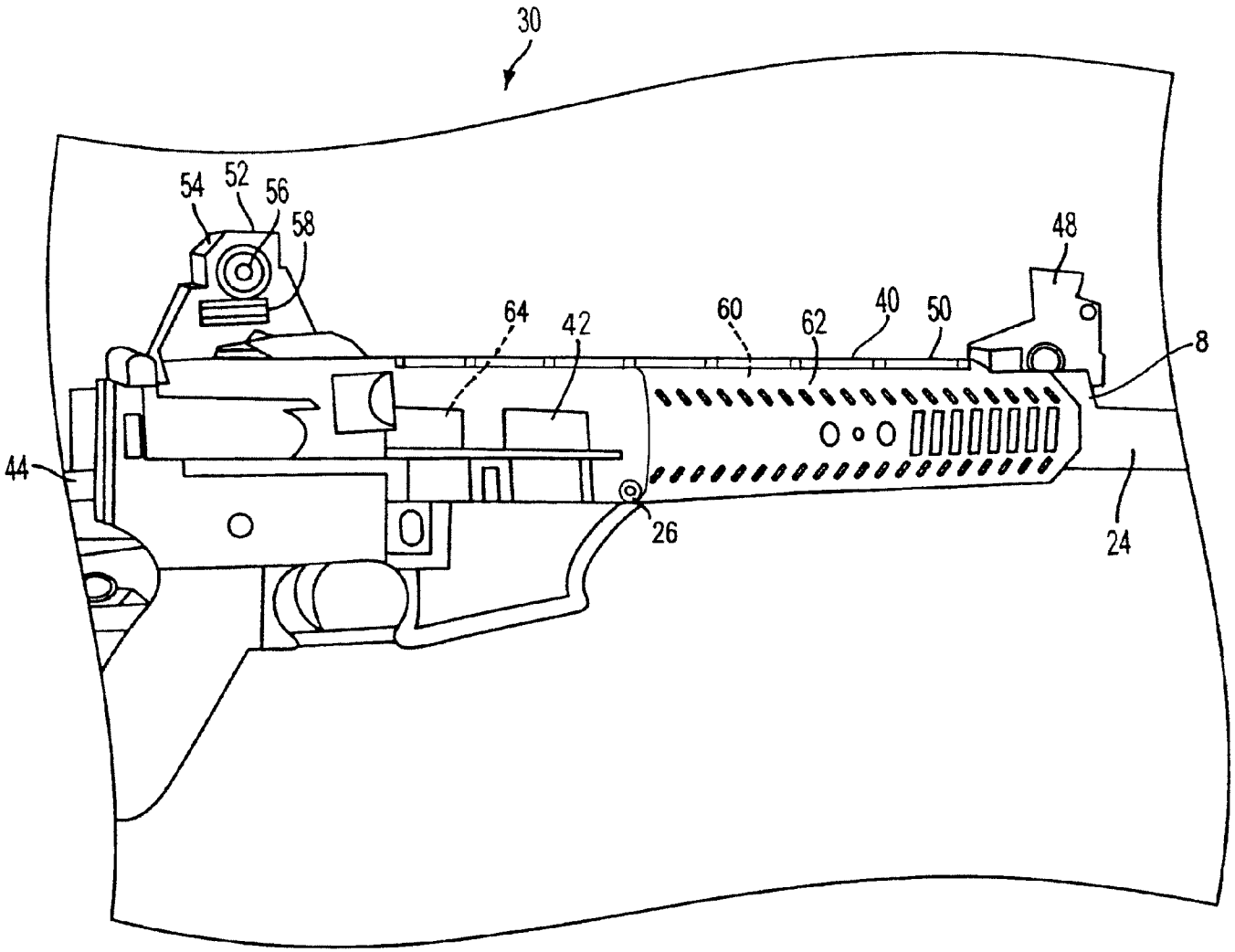
FIG. 1 is a side elevation view of an automatic firearm incorporating features in accordance with an exemplary embodiment.

Referring to FIG. 1, there is shown, a side elevation view of an automatic firearm 30 capable of automatic or semiautomatic fire incorporating features in accordance with an exemplary embodiment. Although the present invention will be described with reference to the embodiments shown in the drawings, it should be understood that the present invention can be embodied in many alternate forms of embodiments. In addition, any suitable size, shape or type of elements or materials could be used.

Firearm 30 is illustrated as generally having an M4 or M16 type automatic firearm configuration. However, the features of the disclosed embodiments, as will be described below, are equally applicable to any desired type of automatic firearm. Firearm 30 may have operational features such as disclosed in U.S. Pat. Nos. 5,726,377, 5,760,328, 4,658,702 and 4,433,610, and patent application Ser. Nos. 60/564,895; 10/836,443 filed respectively on Apr. 23, 2004 and Apr. 30, 2004, all of which are hereby incorporated by reference herein in their entirety. The firearm 30 and its sections described in greater detail below is merely exemplary, and in alternate embodiments the firearm 30 may have other sections, portions or systems. Firearm 30 may incorporate a hand guard 40, a receiver section 42, a barrel 24, and stock 44. As will be described further below, hand guard 40 may further incorporate vent holes, ribbing, heat shields or double heat shields and liners to facilitate cooling of the barrel 24 while keeping hand guard 40 at a temperature sufficient for an operator to hold the handguard.

Figure 8:
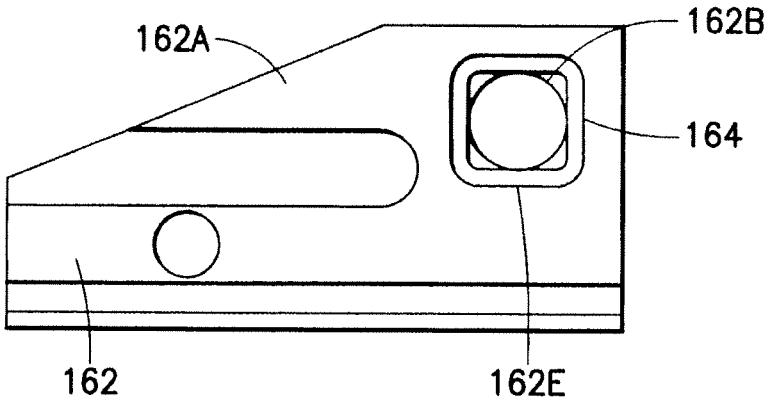
FIG. 8 is an enlarged side elevation view of the base portion of the front sight section of the firearm shown in FIG. 1.
Figure 9A:
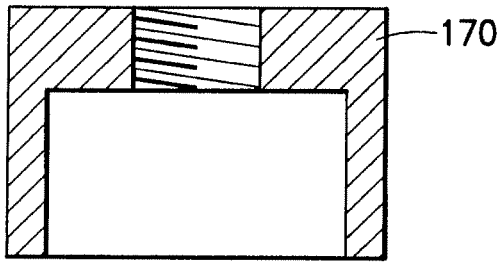
FIGS. 9A-9B are respectively a cross-section of a threaded cap and a side view of a of the front sight section of the firearm shown in FIG. 1.
Figure 9B:
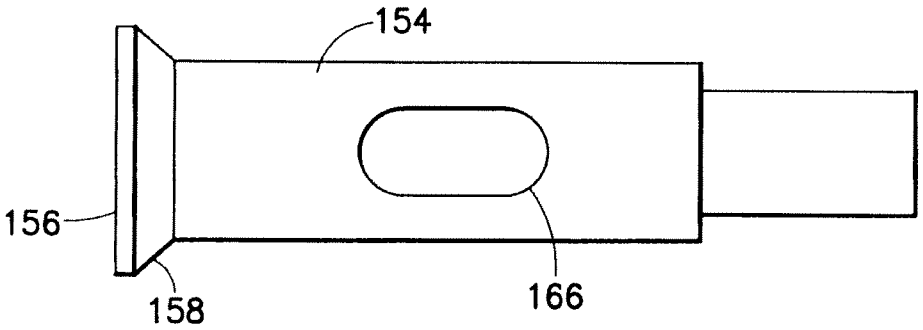

Firearm 30 has an indirect gas operating system 60 facilitating automatic or semi-automatic operation as will be described below. The indirect gas operating system 60 is adjustable, allowing the operator to vary cyclic rate as desired. The system 60 has a gas block 8 having a cylinder therein. Gas block 8 is fitted to a barrel assembly 24 where barrel 24 has a bore with the cylinder being in fluid communication with the bore through a port. A piston and rod assembly 62 having a piston and a striking rod is housed within hand guard 40 and receiver 42. The piston is fitted to the cylinder. A bolt carriage assembly 64 is provided within receiver 42. The bolt carriage assembly 64 has a striking surface cooperating with the rod of the operating system 60. When a cartridge is fired, pressurized gas enters the cylinder, displaces the piston and causes the striking rod to strike the striking surface displacing the bolt assembly. The cyclic rate selector interfaces with the pressurizing gas in the cylinder to vary the bolt carriage cycle rate during automatic operation of the firearm. Hand guard 40 may have features such as disclosed in U.S. Pat. Nos. 4,663,875 and 4,536,982, both of which are hereby incorporated by reference herein in their entirety. Hand guard 40 and receiver section 42 may be configured to support such rails as a "Piccatiny Rail" configuration as described in Military Standard 1913, which is hereby incorporated by reference herein in its entirety. The rails may be made from any suitable material such as hard coat anodized aluminum as an example. Front sight assembly 48 is shown mounted to rail 50 of hand guard 40. Front sight assembly 48 is removable, allowing alternate mounting of desired accessory in its place such as a telescopic sight or laser sight. In alternate embodiments, front sight 48 may be mounted to barrel 24 as shown in the exemplary embodiment in FIG. 8. Rear sight assembly 52 is provided and mounted to receiver section 42. Rear sight assembly 52 incorporates sight ring 54 and sight adjustment knobs 56 and 58. Sight adjustment knobs 56 and 58 are provided to adjust the position of sight ring 54 relative to the barrel 24 and front sight 48 for accurate target sighting.

Figure 2:
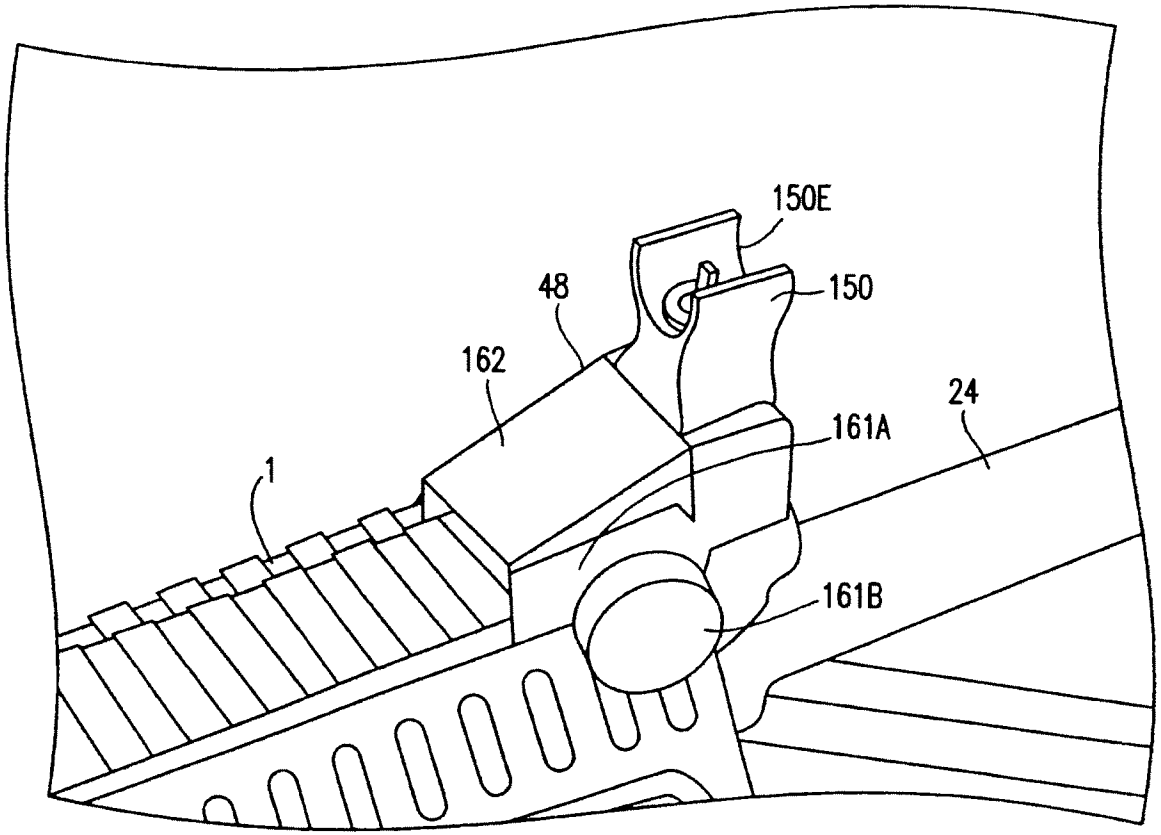
FIG. 2 is a partial top isometric view of the front sight section of the firearm shown in FIG. 1.
Figure 3:
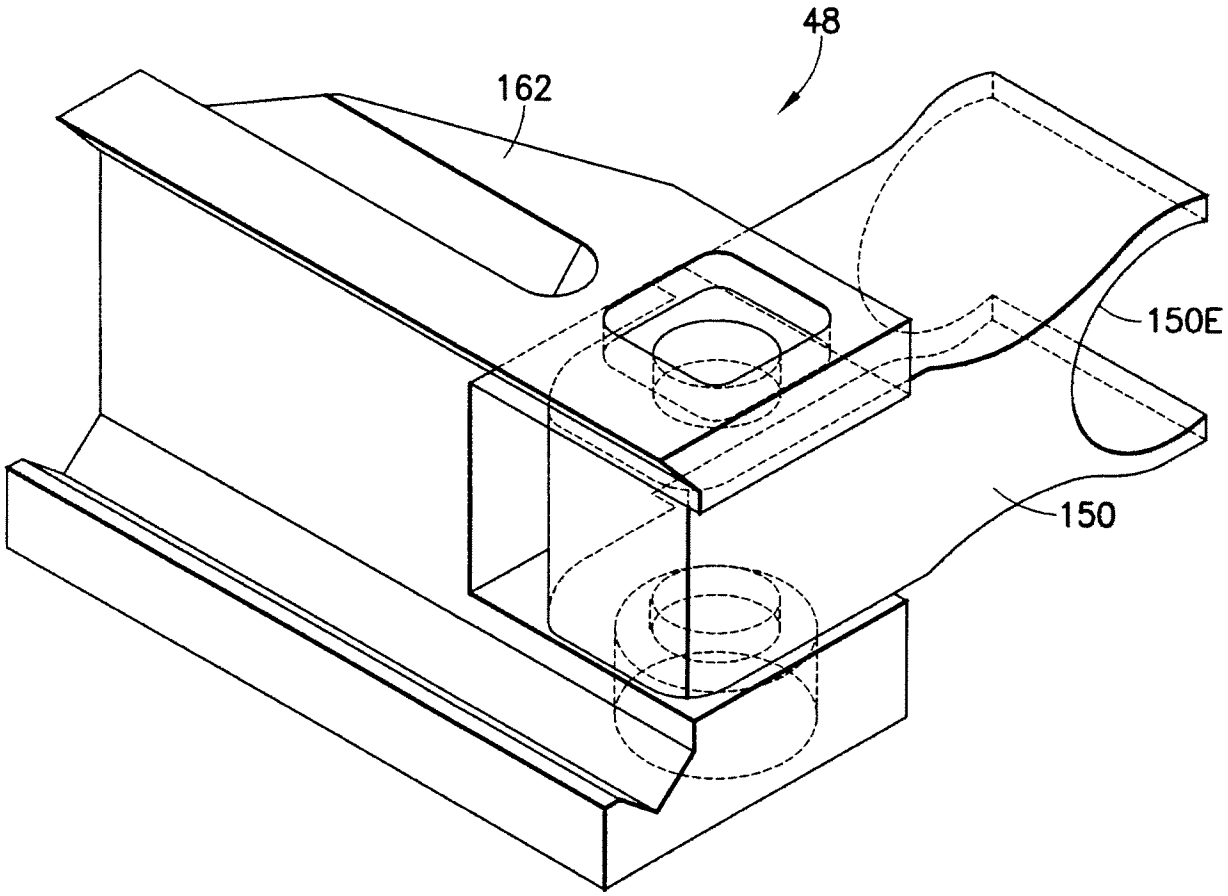
FIG. 3 is a partial isometric view of the front sight section of the firearm shown in FIG. 1.
Figure 4A:
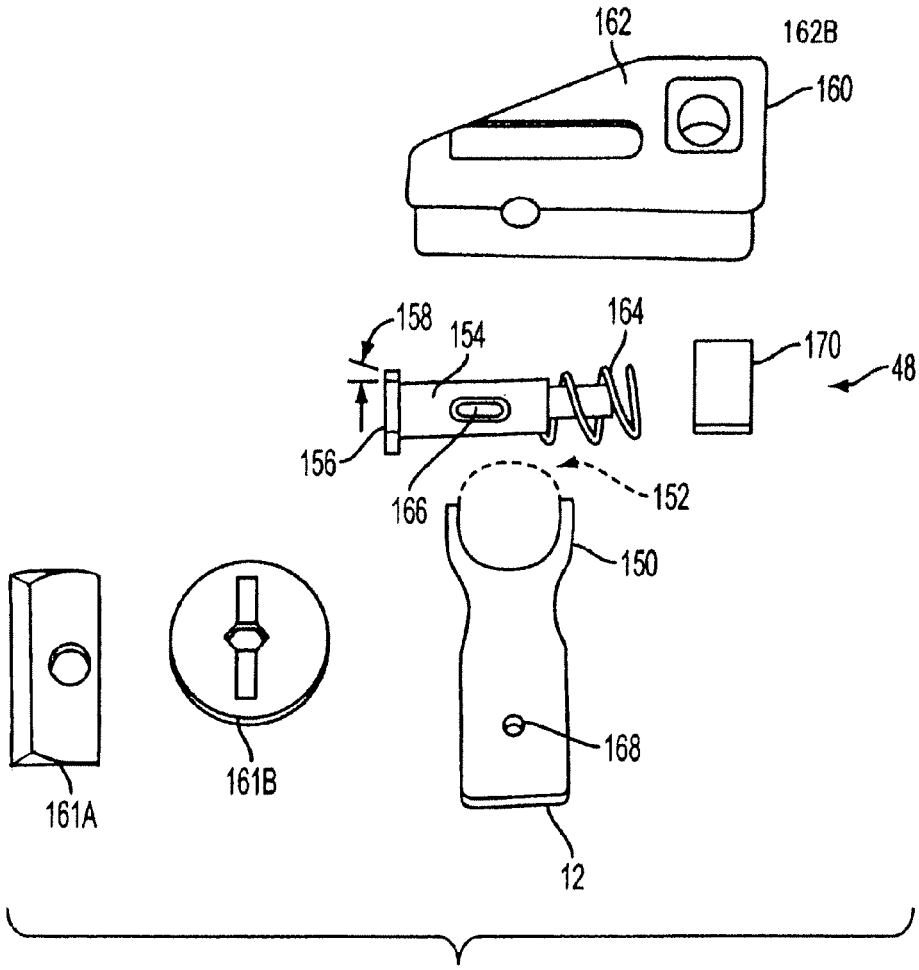
FIG. 4A is an exploded view of the front sight section of the firearm shown in FIG. 1.
Figure 4B:
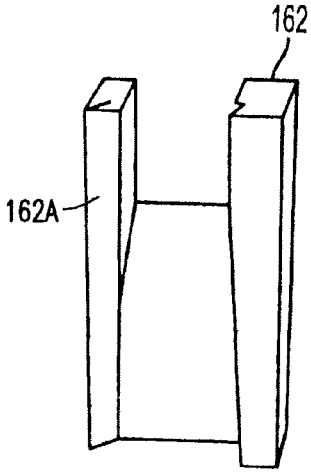
FIG. 4B is a bottom view of a base of the front sight station.
Figure 5:
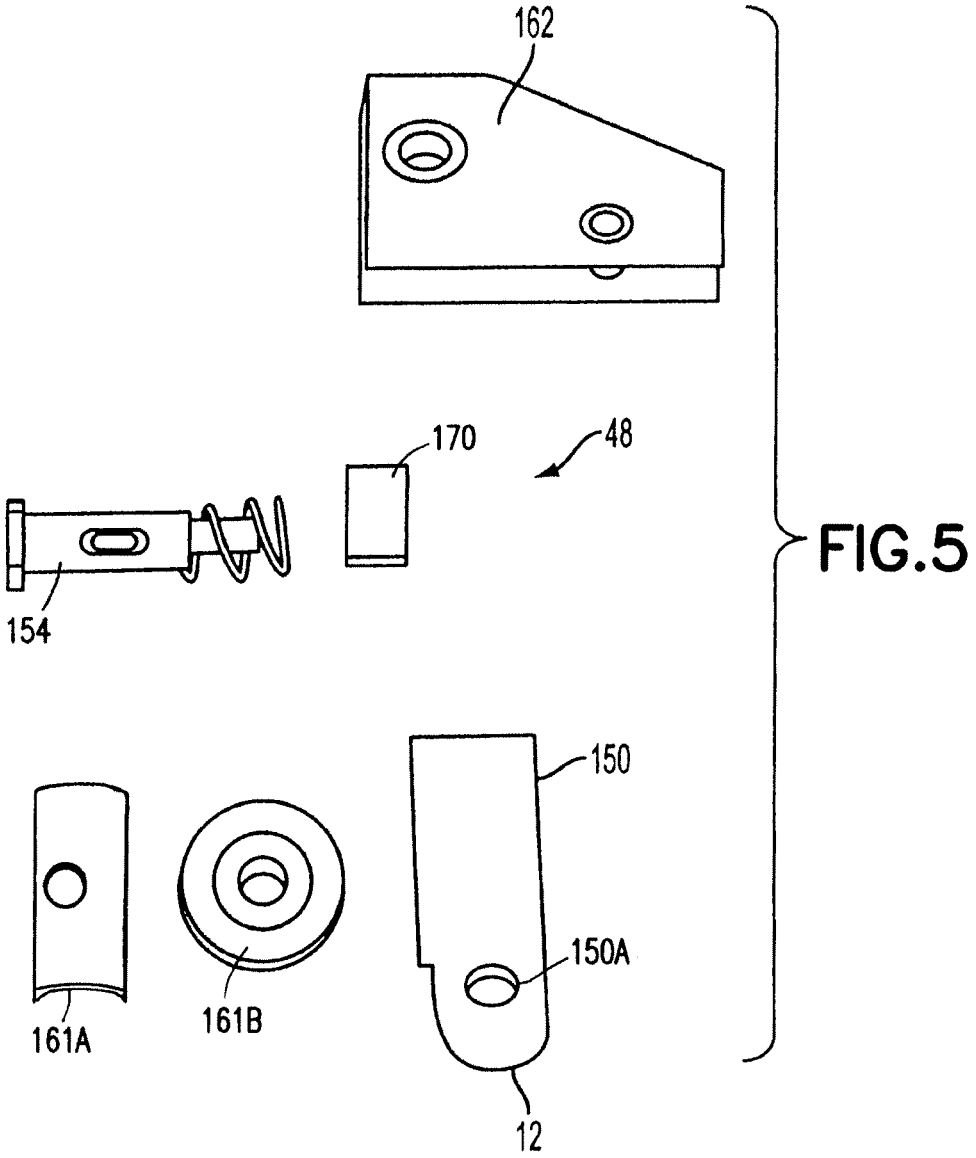
FIG. 5 is another exploded view of the front sight section showing the portions of the front sight section as seen from another direction.
Figure 6C:
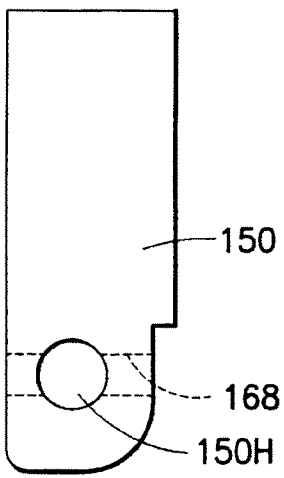
FIGS. 6A-6C are respectively different side elevation views and a cross sectional view of a sight portion of the front sight section of the firearm shown in FIG. 1.
Figure 6B:
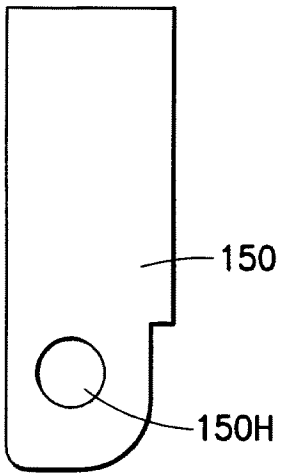
Figure 6A:
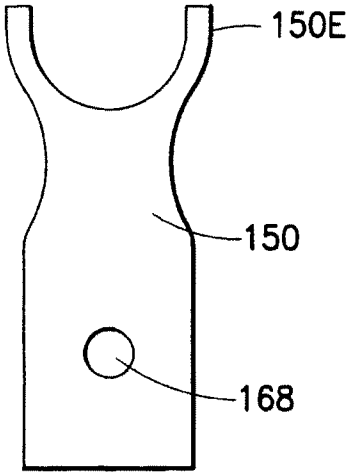
Figure 7A:
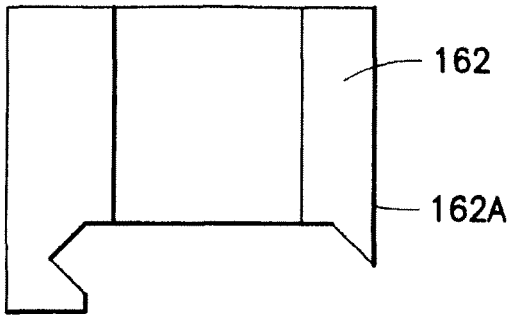
FIGS. 7A-7C are respectively opposite end elevation views and a side elevation is a view of a base portion of the front sight section of the firearm shown in FIG. 1.
Figure 7B:
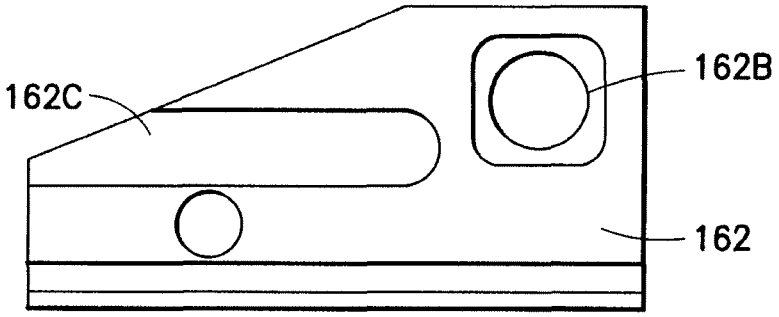
Figure 7C:
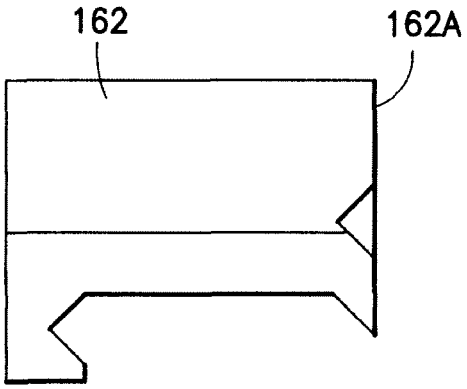

Referring now to FIGS. 2-3, there is shown respectively a partial top isometric view and a schematic bottom isometric view of the front sight section 48 of the firearm shown in FIG. 1. Referring also to FIGS. 4-10 there is shown an exploded view of the front sight section 48 and detailed views of the parts included in the assembly of the front sight section of the firearm shown in FIG. 1. Front sight 48 is shown as a detachable or removable front sight within this embodiment mounting to a "Piccatiny" rail though in alternate embodiments the mounting may have any desired configuration. As seen in FIG. 4, the front sight assembly generally comprises base sections 162, front sight post 150, spring loaded pivot assembly 154 and mounting retention members 161A, 161B (see also FIG. 3). Base 162 includes complementing mounting for the Piccatiny rail to which the front sight assembly 48 in this embodiment is removably mounted. The mounting retention members include clamping bracket or section 161A that is fastened with a locating pin (not shown) to side 162A of the base 162 to clamp the Piccatiny rail. Tightening nut 161B generates clamping pressure to hold the base 162 and bracket 161A on the rail. Base 162 (seen best in FIG. 7) and front sight post 150 (see best in FIG. 6) have complementing features allowing the sight post to be pivotally engaged to the base and shown in FIG. 3. The front sight post 150 is mounted to the base with pin 154 (see FIG. 4). The front sight has a rounded feature 150E that is shaped to coincide with the edges of the hole or ring 152 upon alignment of front and rear sights making it much easier for a user to acquire targets and center the weapon with the combination. The front sight 150 is shown as a raised sight with a folding construction allowing a user to keep the sight in the position shown or rotate the sight to a lowered position. Spring loaded detents lock the sight post 150 in the up or lowered positions. In this embodiment, the pivot pin 154 (see also FIGS. 5 and 9B) is provided with a squared head 156 having tapered features 158 that complement angled edges 162E of receiving hole 162B in base 162 (see FIG. 8). The taper facilitates self centering, improved locking and position locking and reduced sight vibration by taper engagement with a mating feature 160 in base 162 aided by a spring load or bias from spring 164. In alternate embodiments, the sight post may have any other suitable spring loaded detents holding the sight post in desired positions. The pivot pin, positioned within mounting bore 150H, is locked to the sight post 150 by a locking pin (not shown) that mates with slot 166 and hole 168. A thread-on cap feature 170 (see also FIG. 9A) is threaded onto the pin end and retains the spring 164 (see FIG. 5).

Figure 10:
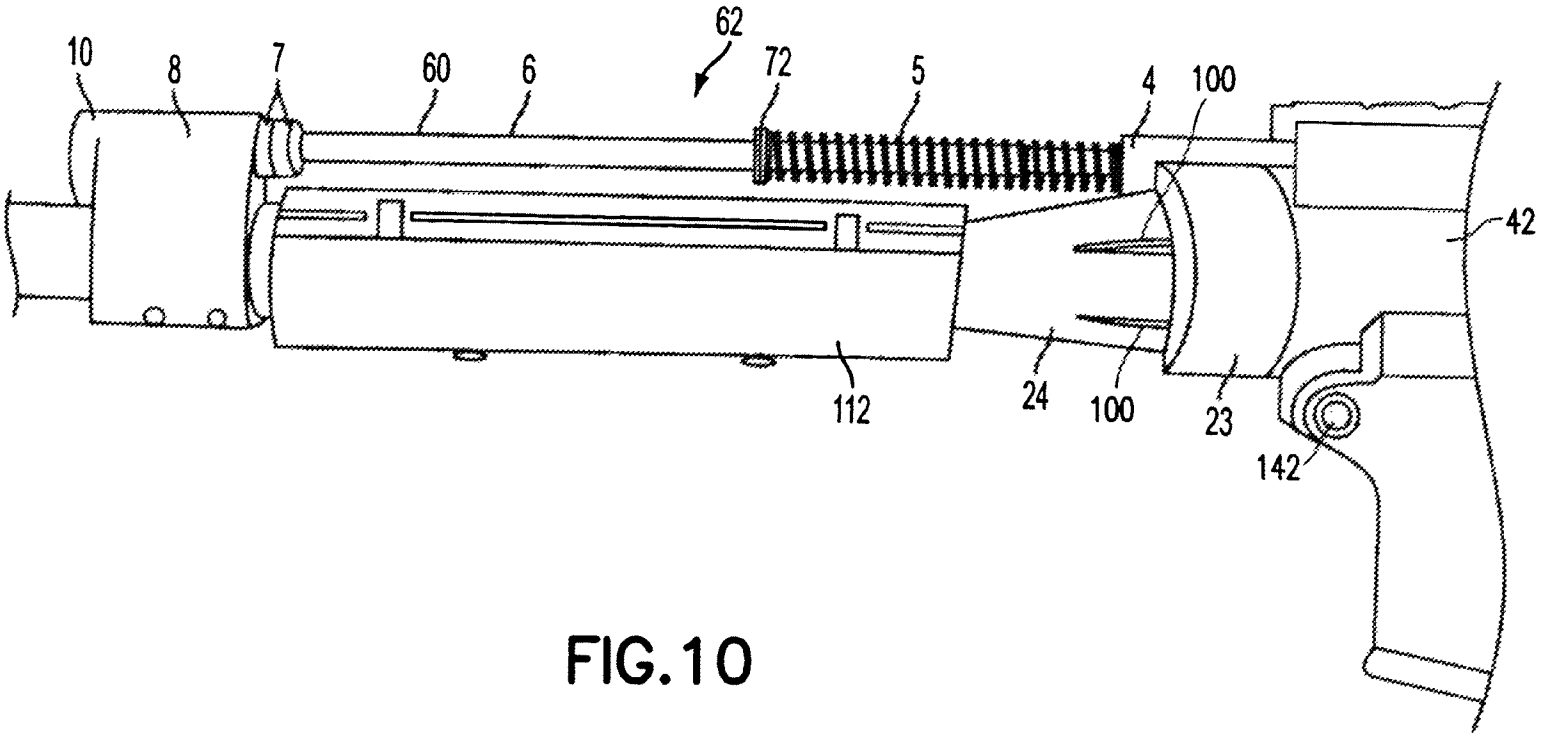
FIG. 10 is a side elevation view of the firearm shown in FIG. 1 with the hand guard removed.
Figure 11:
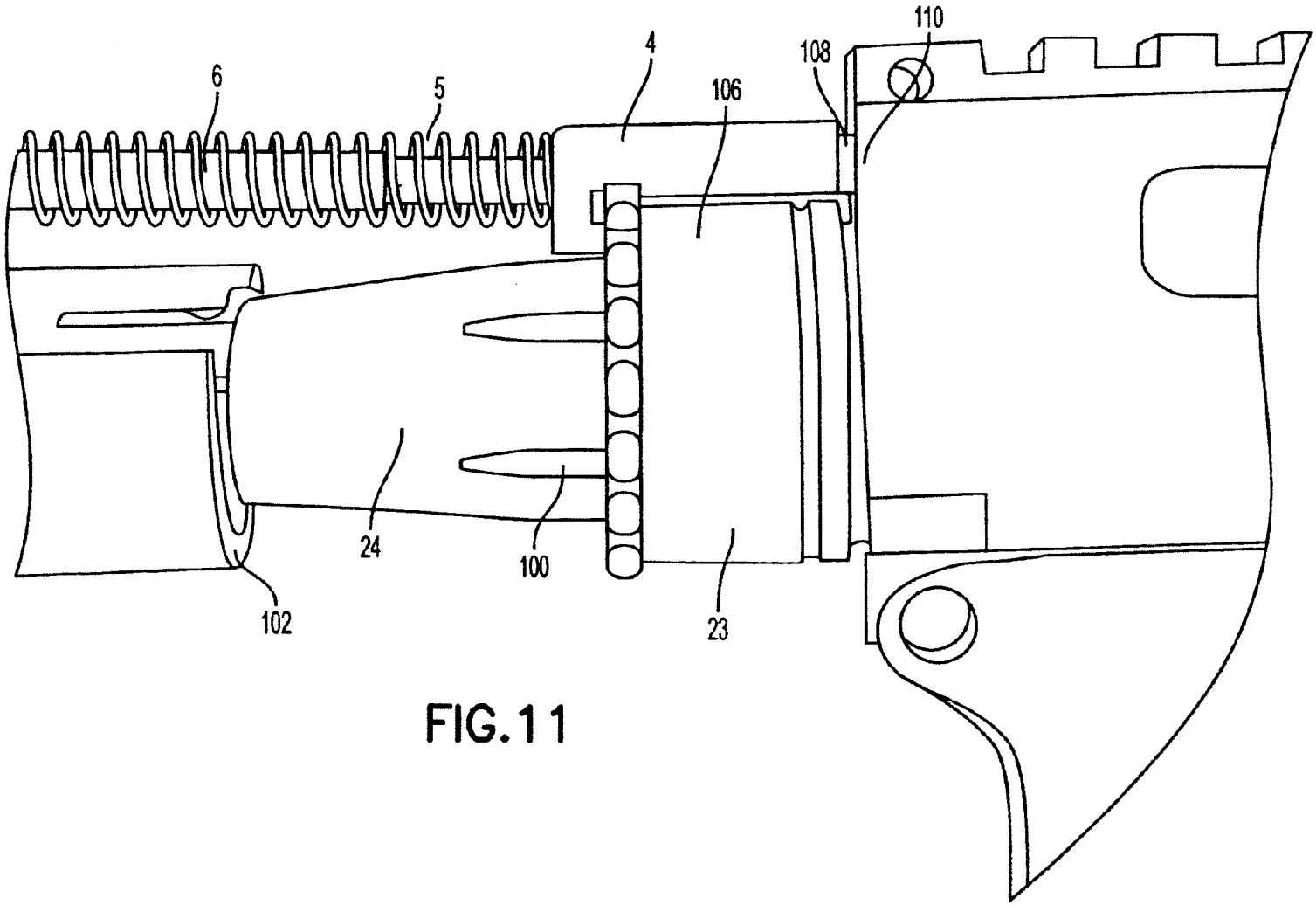
FIG. 11 is an enlarged partial side elevation view of the firearm shown in FIG. 1 with the hand guard removed.
Figure 12:
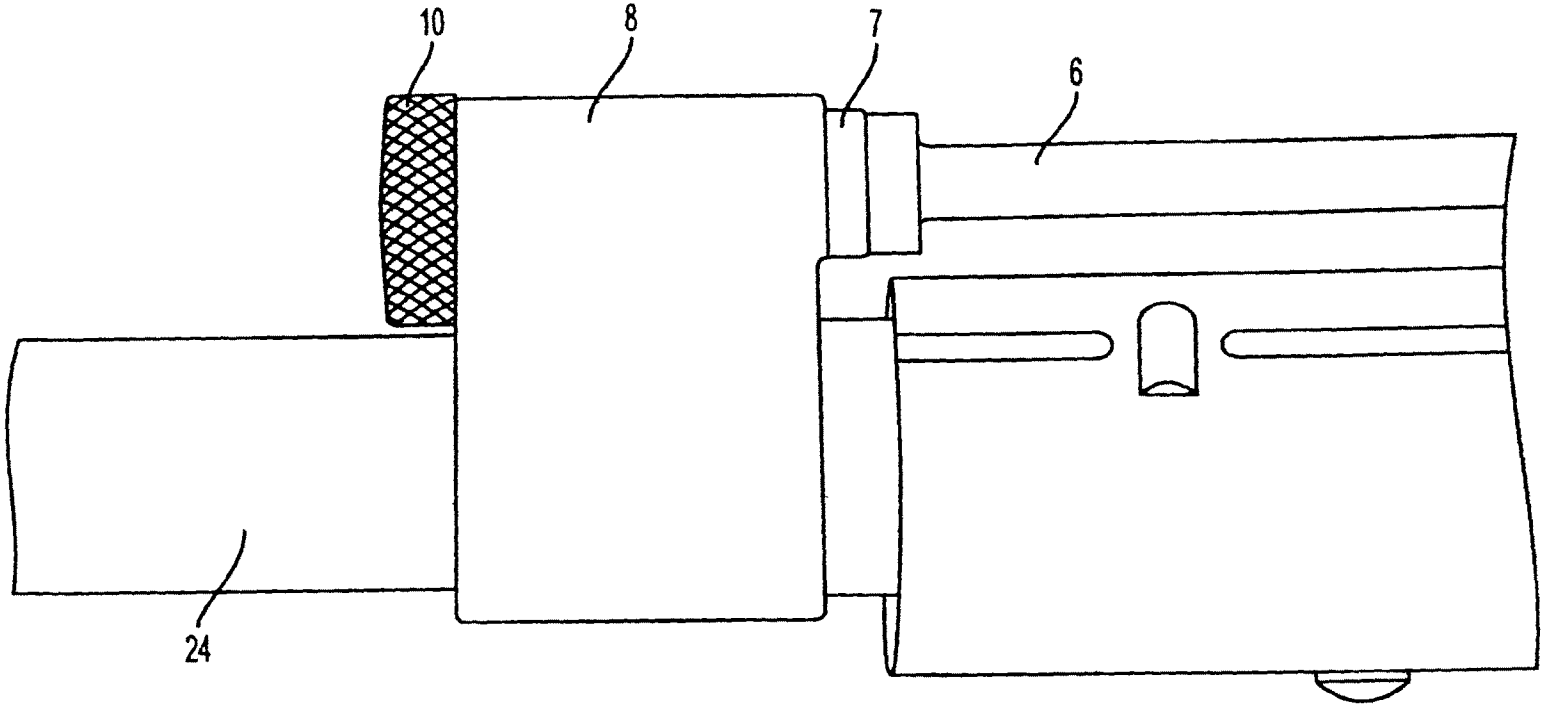
FIG. 12 is another enlarged partial side elevation view of the firearm shown in FIG. 1 with the hand guard removed.
Figure 13:
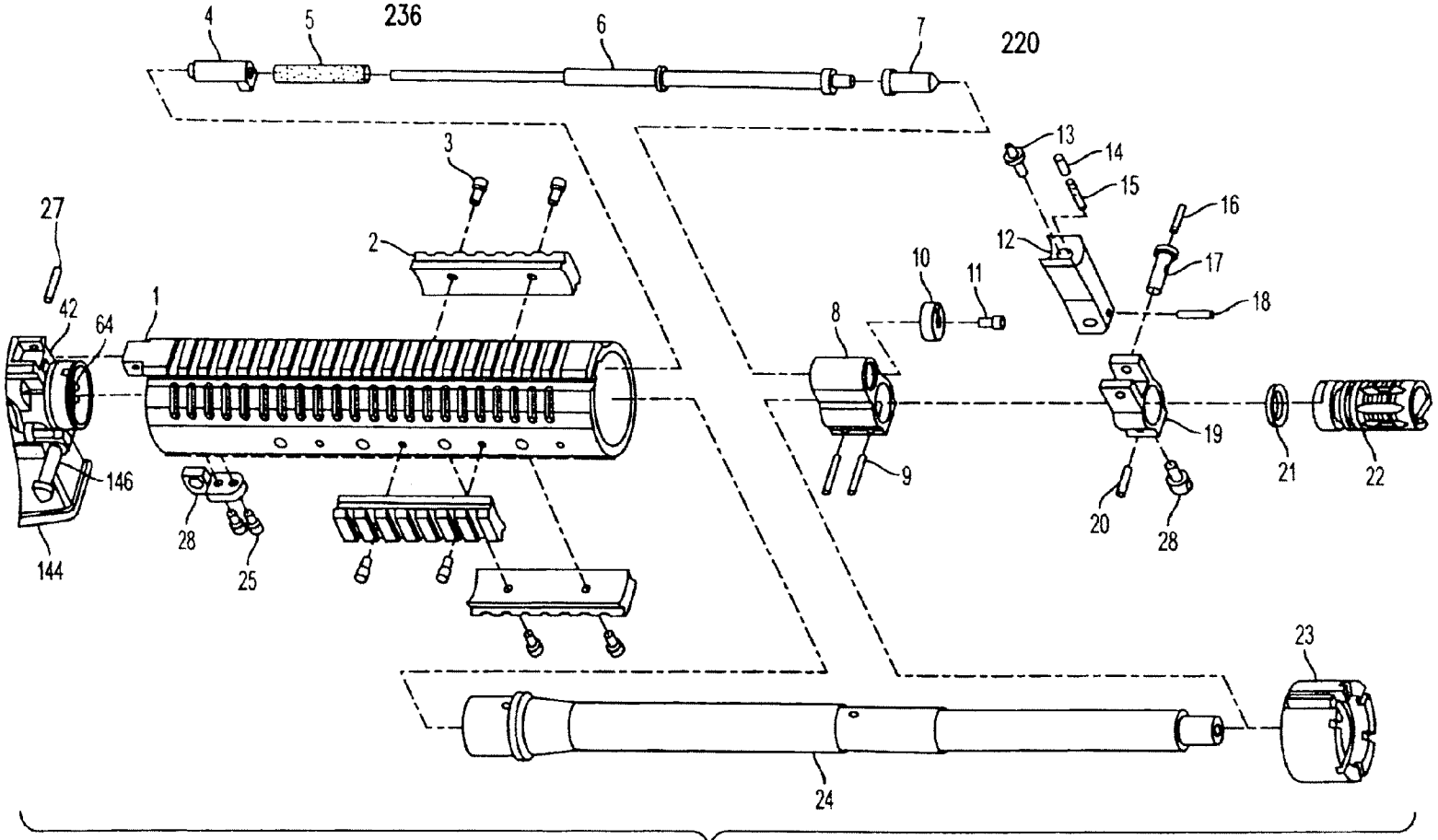
FIG. 13 is an exploded view of an automatic firearm incorporating features in accordance with an exemplary embodiment.
Figure 14:
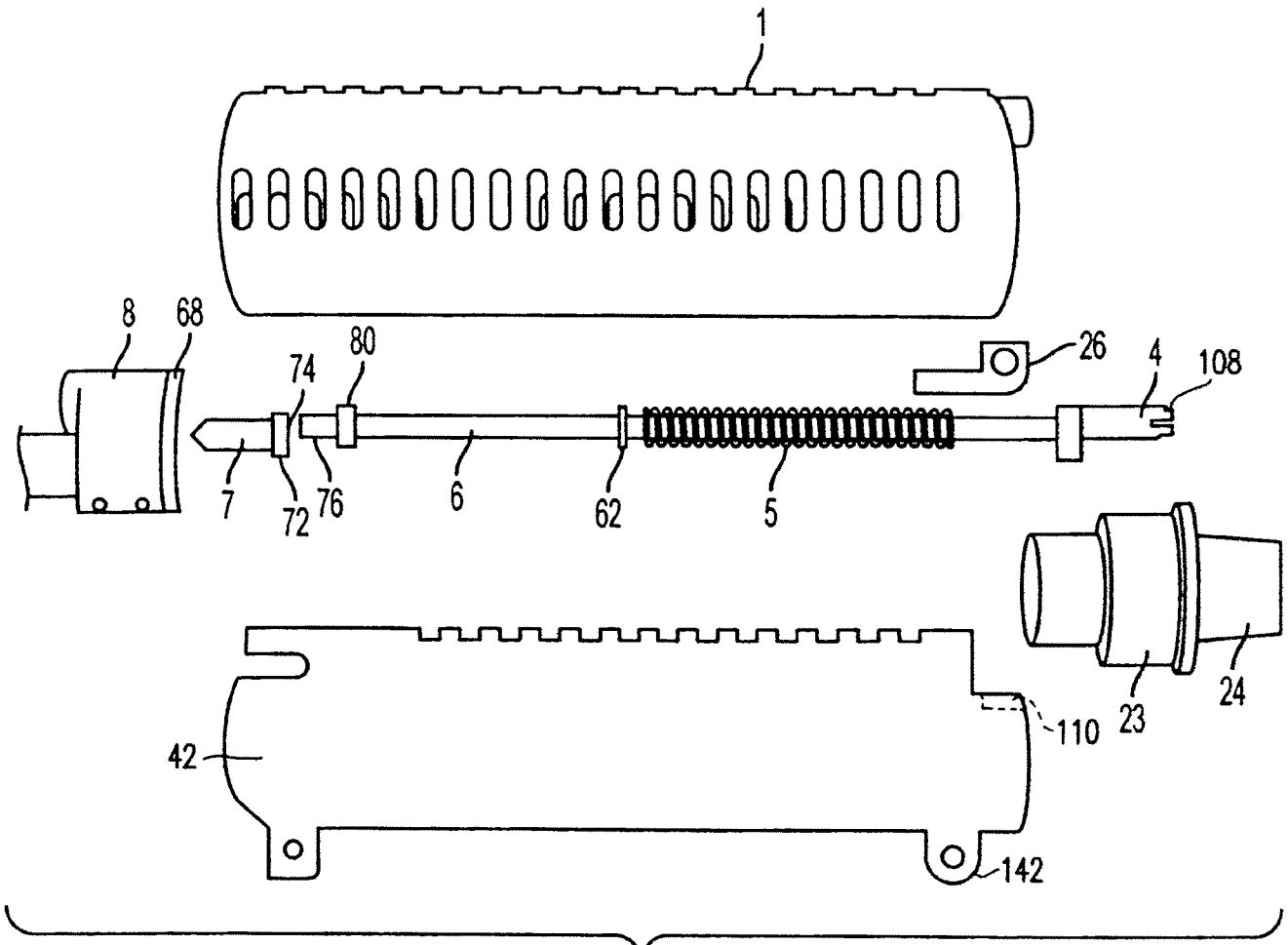
FIG. 14 is a side exploded view of a barrel, receiver, hand guard and gas piston assembly.

Referring now to FIG. 10, there is shown a side elevation view of the firearm shown in FIG. 1 with the hand guard removed. Referring also to FIGS. 11 and 12, there is shown a partial side elevation view of the firearm shown in FIG. 1 with the hand guard removed. Referring also to FIG. 13, there is shown an exploded view of an automatic firearm incorporating features in accordance with an exemplary embodiment. Referring also to FIG. 14, there is shown a side exploded view of the barrel, receiver, hand guard and gas piston assembly of the firearm shown in FIG. 1.

Figures 15, 15A:
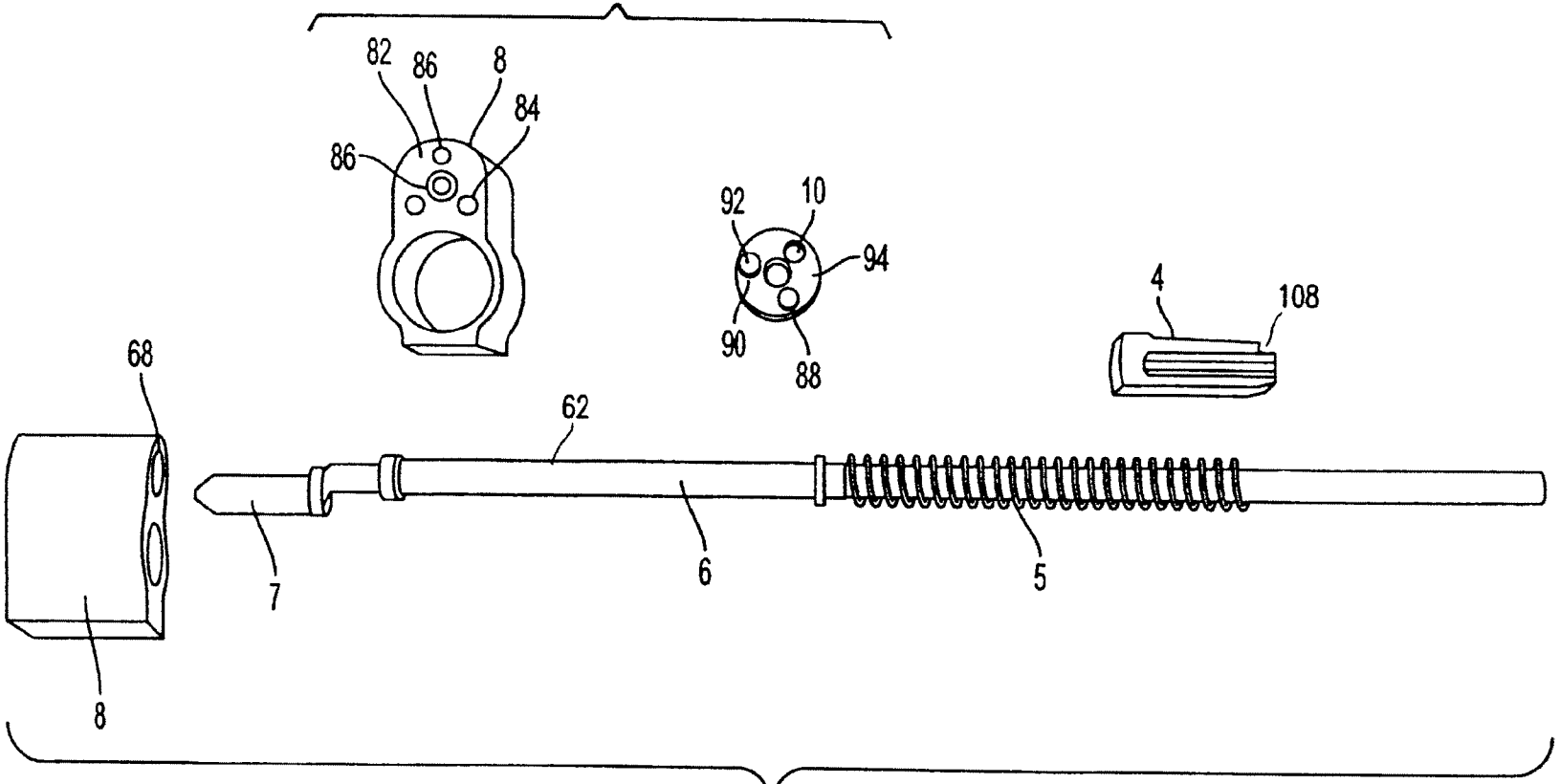
FIG. 15 is a side exploded view of a gas piston assembly and FIG. 15A is an exploded end view of the gas block.
Figure 16:
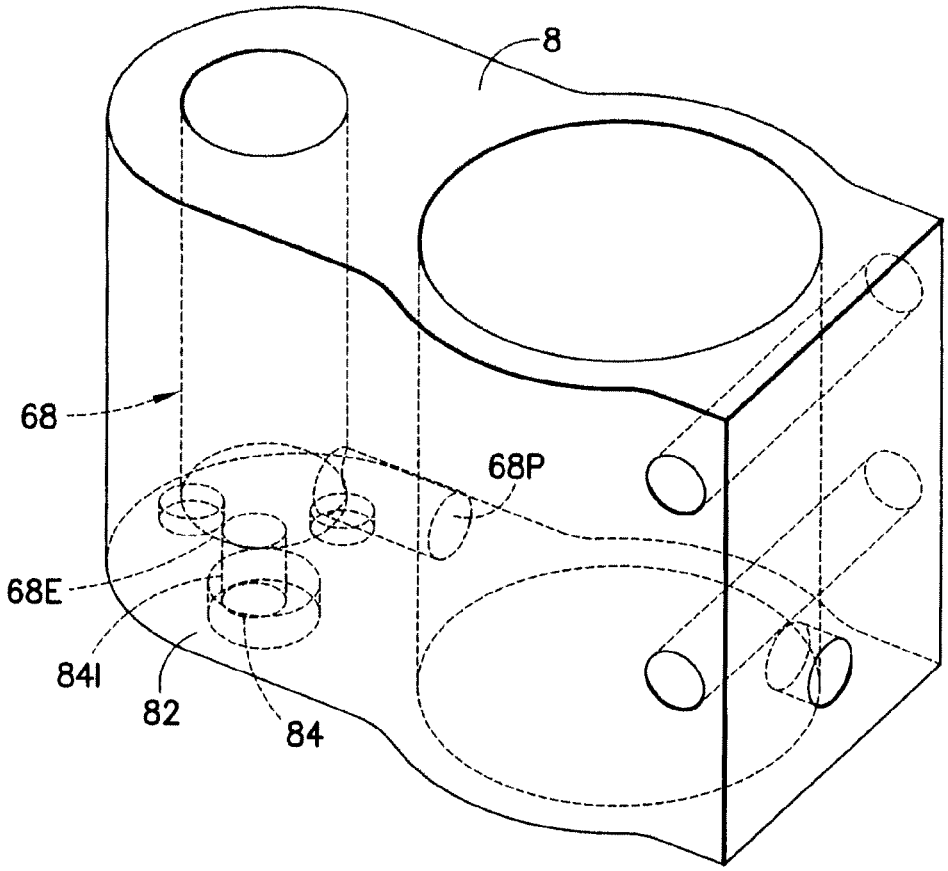
FIG. 16 is a schematic perspective view of another portion of the gas piston assembly.
Figure 19:
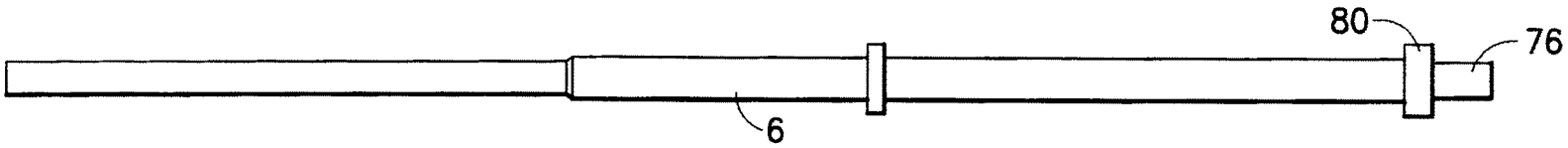
FIG. 19 is a side view of an operating rod of the gas piston assembly.
Figure 20:
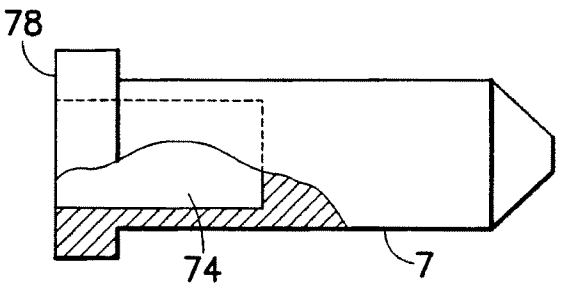
FIG. 20 is a side view of still another of the gas piston assembly.

Referring also to FIG. 15, there is shown another exploded view of the gas piston assembly and FIG. 15A is an end elevation of the gas block and rate selector in accordance with an exemplary embodiment. As noted before, firearm 30 has an indirect gas operating piston system 60 (see FIG. 10). The indirect gas operating system 60 has a gas block 8 having a cylinder 68 therein. The gas block is schematically shown in perspective in FIG. 16. Gas block 8 is shaped to be mounted to the barrel assembly 24. Barrel 24 has a bore (not shown) for exhausting firing gases. The cylinder 68 in the gas block is in fluid communication with the bore through a port 68P disposed on a surface of the gas block facing the barrel. A piston and rod assembly 62 having a piston 7 and a striking rod 6 (housed within hand guard 40 and receiver 42 when mounted to the firearm) cooperate with the gas block 8. The piston 7 (see FIG. 20) is movably fitted to the cylinder 68. The striking rod 6 (see also FIG. 19) is fixedly joined at its front end, for example by a threaded connection, to the piston 7. In this embodiment, piston 7 has a bore 74 that accepts the tip 76 of rod 6. Piston 7 has a shoulder 78 that mates with flange 80 of rod 6. In alternate embodiments, other engagement techniques could be provided. Gas block 8 is fitted onto barrel 24. Thus, gas block 8 has a cylinder 68 that houses piston 7 with the piston 7 engaging rod 6 that extends back to engage bolt assembly 64. The bolt carriage assembly 64 is provided within receiver 42 (see FIG. 13) with the bolt assembly carriage 64 having a striking or engagement surface that is engaged by the rear end of the operating rod as will be described below. When a cartridge is fired, pressurized gas from the barrel enters the cylinder, displaces the piston and causes the engaging rod 6 to strike a striking surface on the bolt carriage assembly displacing the bolt assembly. Guide 4 (see FIG. 5) houses operating rod 6 allowing operating rod 6 to slide freely relative to the receiver. Guide 4 also has a feature 108 that mates with mating feature 110 (see FIGS. 14, 15) of receiver 42 to correctly position rod 6 relative to the bolt carriage assembly within receiver 42. Spring 5 is provided between shoulder 72 of rod 6 and guide 4 to bias the rod toward the gas block.

Figure 17:
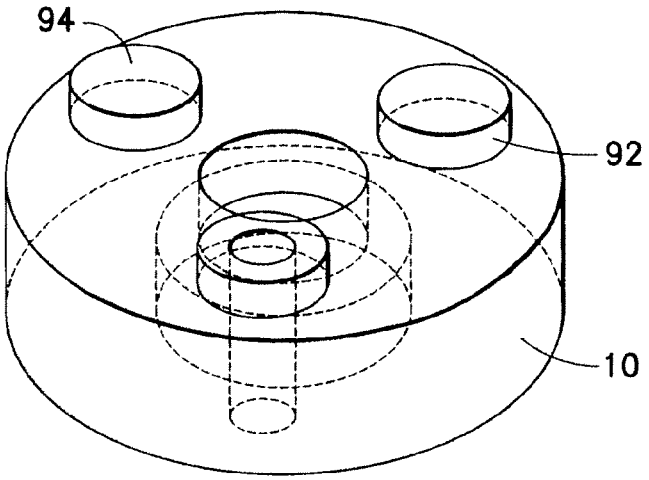
FIG. 17 is a side exploded view of a portion of a gas piston assembly.
Figure 18:
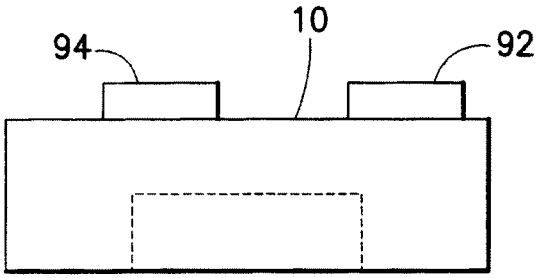
FIG. 18 is a side view of the portion of the gas piston assembly seen in FIG. 17.

The indirect gas operating system 60 in this embodiment has valving or pressure regulator to allow the user to select desired operating pressure and hence to select the cyclic rate. In this case, the regulator is incorporated into the gas block, and adjustment is provided by a rotating knob 10 (a perspective view of which is shown in FIG. 17). The gas pressure that is exerted on the piston may be varied by the user by loosening fastener 11 (see FIG. 13) and rotating knob 10. By rotating knob 10 to selectable positions, different charges or rates are applied to the piston by variable gas pressure and selectable force. The knob 10, in the embodiment shown in FIGS. 17-18, generally covers the end 82 of gas block 8 opposing the piston (see also FIG. 15). In particular, knob 10 covers or interfaces with a portion of the cylinder 68 that has an exhaust port 84. In alternate embodiments, the knob could have a different shape or be in a different position. The cylinder 68 (see FIG. 16) has one or more exhaust orifices or ports 84 formed in the front end 82 of the gas block. In the embodiment shown the port 84 (one is shown, but any suitable number may be provided) is offset from the center of the cylinder 68 or the knob. In this embodiment, the port 84 is located in a region generally between the cylinder 68 and barrel 24, and away from the top most portion of the gas block. This allows the gas block profile (i.e. the height above the barrel) to be minimized so that the gas block may be accommodated within the hand guard, and the size of the exhaust port is not impacted. In this embodiment port 84 has an inlet 84I in the end face 68E of the cylinder 68 opposing the piston I. In alternate embodiments, the port inlet may be located on any other desired surface of the cylinder. Blind hole 86 may also be provided to locate features 88, 90 of knob 10 correctly. The end of the gas block may also have a threaded hole for fastener 11, though in alternate embodiments the gas block may have an integral fastening post onto which the knob 10 is threaded. The knob also has one or more bosses complementing port 84 and having exhaust orifices or ports 92, 94 with different bore sizes or diameters in the embodiment shown offset from the center of the cylinder or the knob. The holes 92, 94 are sized for each to allow a different desired exhaust flow such as may be used with different particular charges. One boss position may be blind or has no hole or is completely blocked. In alternate embodiments the knob may have any desired number of selectable positions. This allows the user to have increased flexibility as to the ammunition or charge used. Thus, by rotating the knob, the effective size of the port or orifice exiting the cylinder to ambient air may be increased, decreased or eliminated allowing gas to either blow through the orifice at a variable rate, thus controlling the amount and pressure of gas applied to the piston. In alternate embodiments more or less holes or orifices may be provided. In the embodiment shown, exhaust gasses are directed toward the muzzle of the firearm, away from the operator; in alternate embodiments, other directions or locations could be provided. In the embodiment shown, the gas block 8 and the piston 7 and rod assembly 6 fits within the hand guard assembly in a low profile relative to other block systems. The embodiment shown may employ a short barrel 24 with a shorter operating rod that results in higher impact loads to the bolt assembly.

Figure 21:
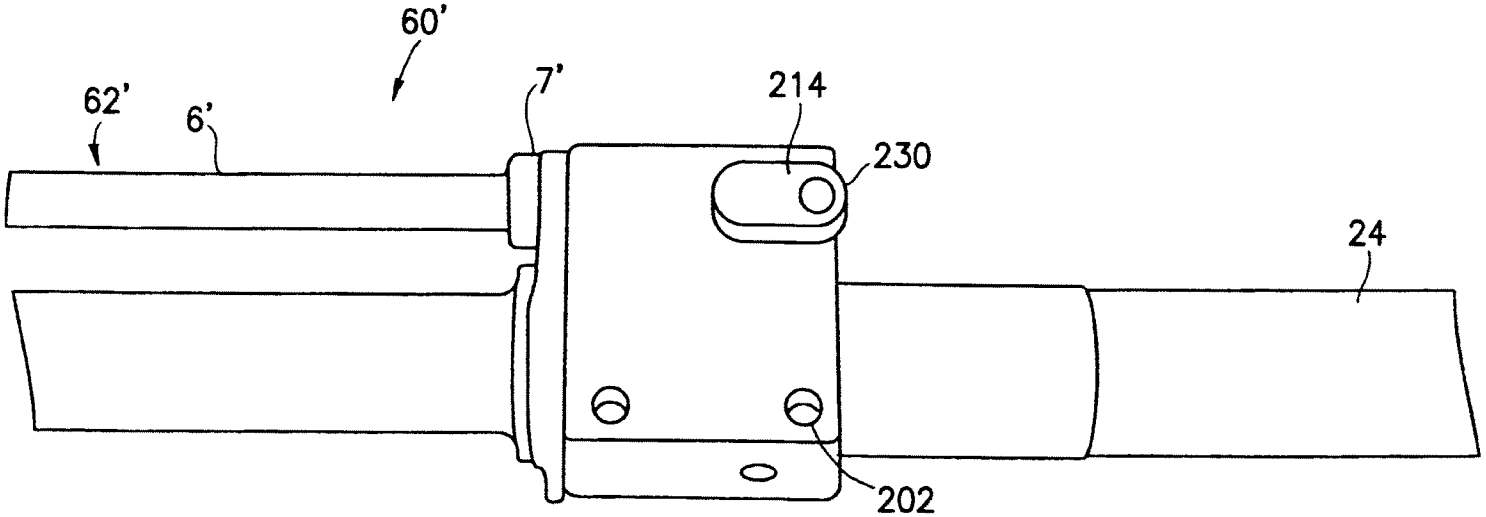
FIG. 21 is a partial side view of the firearm showing a portion of a gas piston assembly in accordance with another exemplary embodiment.
Figure 22:
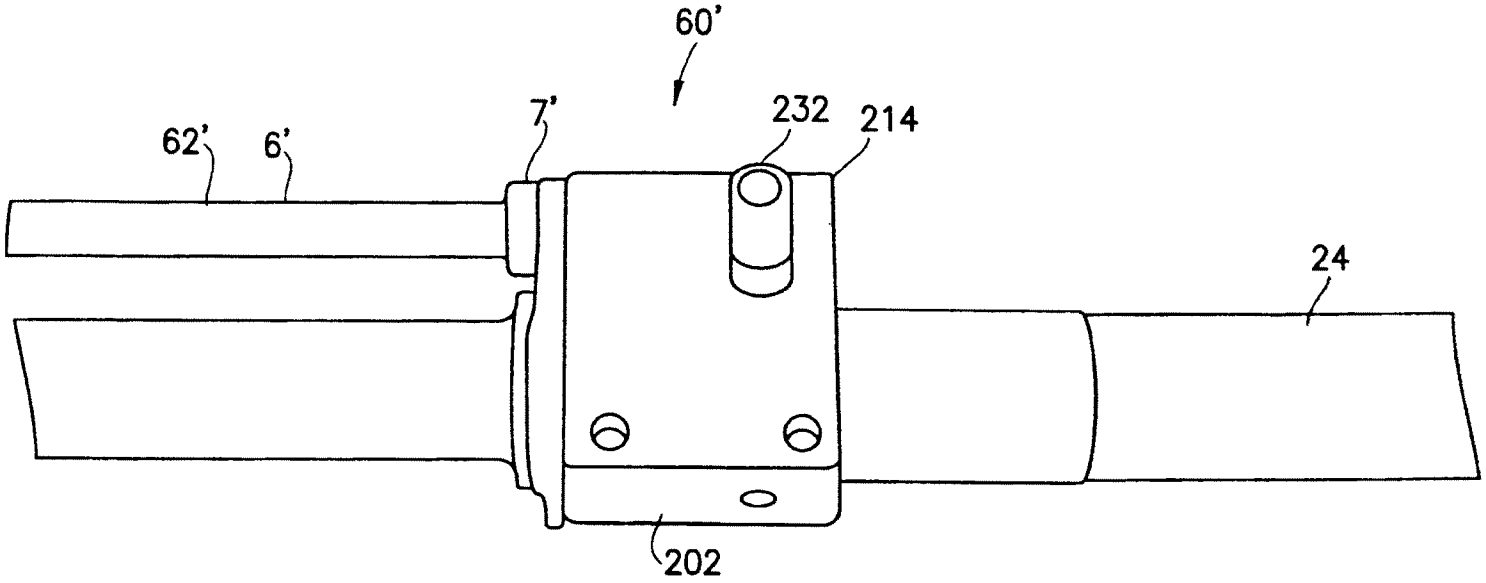
FIG. 22 is another partial side view of the gas piston assembly in FIG. 21 with the cyclic selector in a different position.
Figure 28:
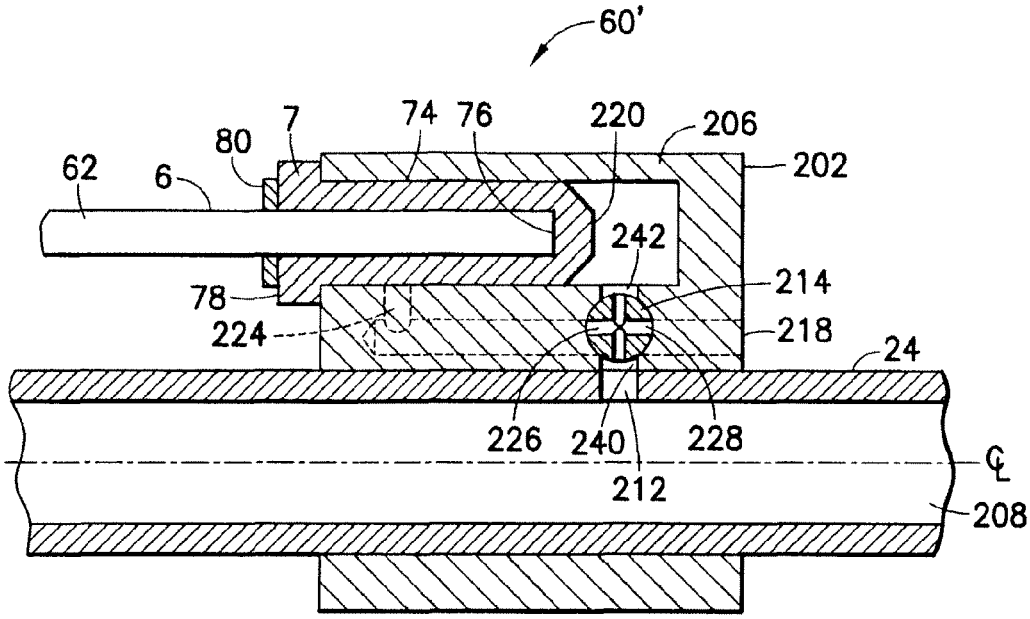
FIG. 28 is a section view of a gas piston assembly and firearm barrel.

Referring also to FIGS. 21 and 22, there are shown partial elevation views of a firearm 30 with an indirect gas operating piston system 60' in accordance with another exemplary embodiment. Referring also to FIG. 28, there is shown a section view of the gas piston assembly 60'. As noted before, firearm 30 is illustrated in the figures as having a general M4 type configuration for example purposes, but may be any suitable type of automatic or semi-automatic firearm having an indirect gas operating system 60'. As noted before, firearm 30 may have a bolt carriage assembly 64 having a striking surface 126 (see FIG. 32), where the bolt assembly is enclosed within the receiver assembly 42 (see also FIG. 13) where barrel assembly 24 may be coupled to the receiver assembly 42. Though FIG. 1 shows an M4 type firearm, it is noted that the gas piston assembly 60', in accordance with the exemplary embodiment described herein, may be used with any type of automatic or semi-automatic firearm having an indirect gas operating system operating the bolt assembly. Except as otherwise noted, indirect gas operating system 60' is similar to gas operating system 60 described before. Similar features are similarly numbered. Gas block 202 having cylinder 206 may be fitted to barrel assembly 24, with the cylinder 206 in communication with the bore 208. Piston and rod assembly 62' having a piston 7' and a engaging rod 6', have piston 7' fitted to cylinder 206. Gas discharged from a fired cartridge displaces piston 7' and causes engaging rod 6 to strike striking surface 126 displacing bolt assembly 64. Exhaust port 218 may be in communication with cylinder 206 and piston 7 whereby gas is exhausted when piston 7' reaches for example an end stroke position opening exhaust outlet 224 in the cylinder 206. In alternate embodiments, other exhaust ports may be provided or selectable between positions. The cylinder 206, and piston 7' therein are in communication with barrel bore 203 via passages 240, 242 and an intermediate throttle or regulator 214 having selectable positions 230, 232 (see FIG. 21, 22) corresponding to selectable firing rates. In this embodiment, the regulator 214 is shown as having two selectable positions 230, 232 corresponding to two selectable firing rates. In alternate embodiments, more or less selectable positions, corresponding to more or fewer selectable firing rates may be provided. Intermediate regulator 214 may be switched between the two selectable positions 230, 232 by an operator without the use of specific tools (e.g. screwdriver, wrench, dedicated key) where the operator simply rotates an arm of the selector 214 as shown in positions 230, 232. As described before, piston 7' may be spring biased toward cylinder 206 and piston 7' and striking rod 6' may be separable (e.g. The striking rod 6' is fixedly joined at its front end, for example by a threaded connection, to the piston 7'. In this embodiment, piston 7' has a bore 74' that accepts the tip 76' of rod 6'. Piston 7' has a shoulder 78' that mates with flange 80' of rod 6'. In alternate embodiments, other engagement techniques could be provided. In alternate embodiments, piston 7' and rod 6' may be monolithic. The piston assembly may have a piston end 220, and a striking end 236 (see FIG. 13), where the piston end may be fitted to cylinder 206. Here, gas discharged from a fired cartridge displaces piston 7' and causes striking end to strike and displace bolt assembly 64. The intermediate regulator 214 throttles or regulates the flow of the pressurized gas from the barrel bore 208 to the cylinder 206. As noted before, intermediate regulator 214 may have two selectable positions 230, 232 corresponding to two selectable firing rates, such as, for example 800 and 1000 rounds per minute. In alternate embodiments, other factors, such as load type and size may be selectable between the two selectable positions 230, 232 by an operator without the use of tools. In the exemplary embodiment, the intermediate regulator 214 may have throttling orifices 228, 226 positioned in communication passages 240, 242 as shown for example in FIG. 28. In alternate embodiments any desired number of throttling orifices may be used and may have any desired shape. The cylinder 206 in communication with the bore 208 via the first orifice 228 when intermediate regulator 214 is in a first selectable position 230. The cylinder 206 is in communication with bore 208 via second orifice 226, when intermediate regulator 214 is in a second selectable position 232. Here, the first and second selectable positions 230, 232 correspond to first and second firing rates where the first and second orifices 226, 228 are of different size. Such size may be determined by orifice effective flow diameter, or other suitable feature. In the embodiment shown, intermediate regulator 214 is rotationally housed within block 202. In the section shown in FIG. 28, intermediate regulator 214 has orifices 226, 228 positioned to connect passages 240, in communication with bore 208 in barrel 24 and passage 242 in communication with the cylinder 206. In FIG. 28, regulator passages 216 connects passages 240, 242 throttling flow from barrel 24 to cylinder 206 corresponding to one selectable cyclic rate. As may be realized, when the regulator 214 is rotated so that regulator passage 228 connects passages 240, 242, flow between barrel and cylinder is throttled corresponding to another selectable cyclic rate. The embodiment shown may be provided with any suitable combination of features, such as where bolt assembly 64 may have a removable striking surface 126 (see FIGS. 33, 34). Here, cylinder 206 may be fitted to the barrel assembly 24 with cylinder 206 in communication with bore 208 via intermediate regulator 214 having two selectable positions 230, 232 corresponding to two selectable firing rates. As described before, gas discharged from a fired cartridge displaces piston 7' and causes the striking end of the engaging rod 6 to displace bolt assembly 64 where intermediate regulator 214 regulates the flow of the gas from the bore 208 to the piston 7'.

Figure 23:
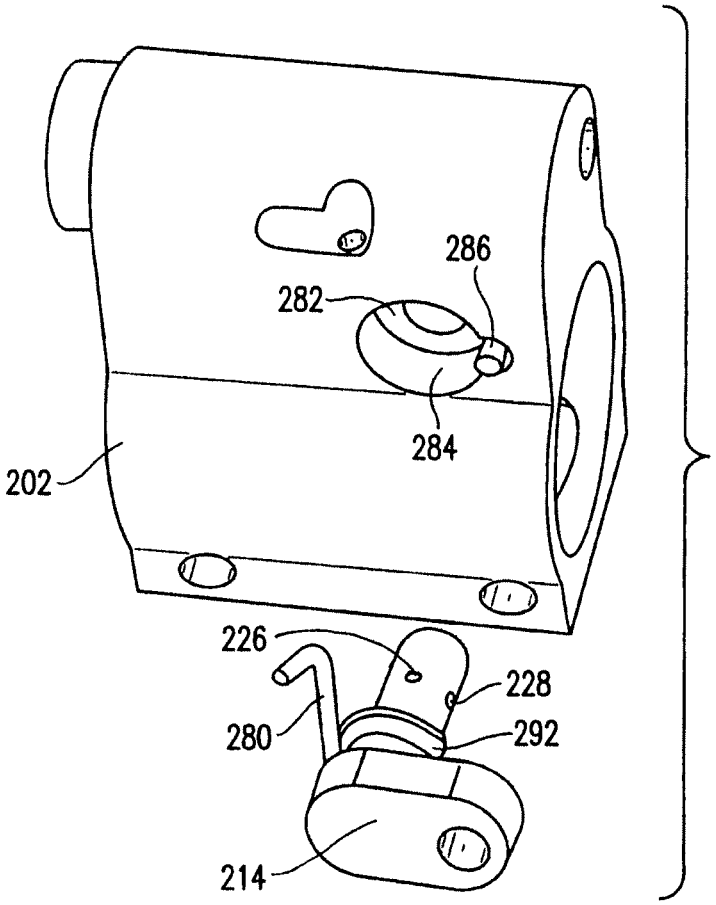
FIG. 23 is an exploded view of the gas piston assembly in FIG. 21.
Figure 24:
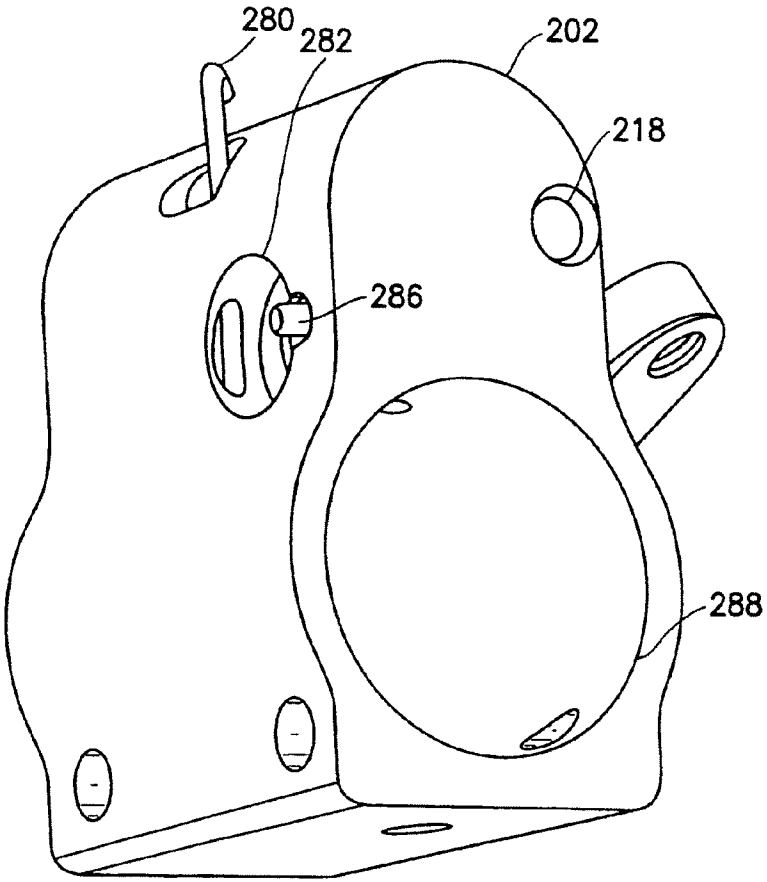
FIG. 24 is a perspective view of the gas block in FIG. 23.
Figure 25:
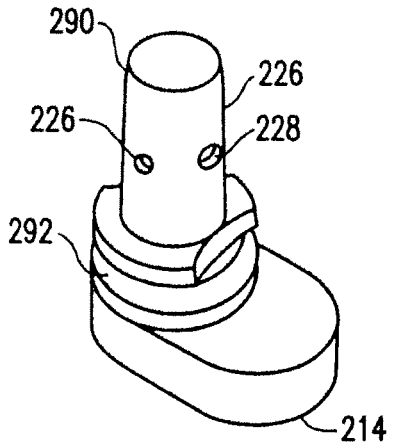
FIG. 25 is a perspective view of the selector of the gas piston assembly in FIG. 23.
Figure 26:
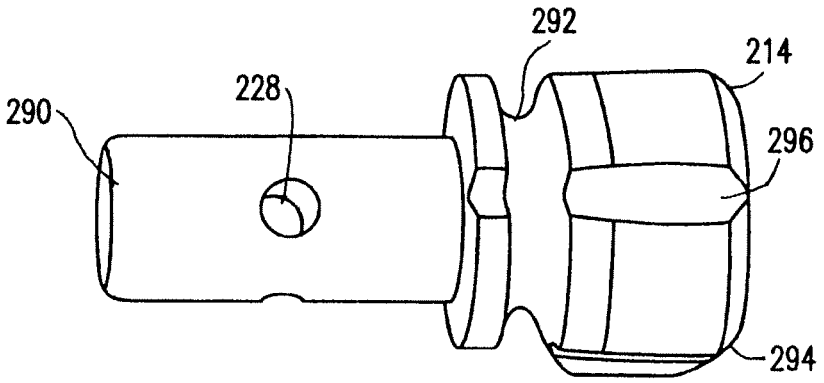
FIG. 26 is another perspective view of the selector of the piston assembly.
Figure 27:
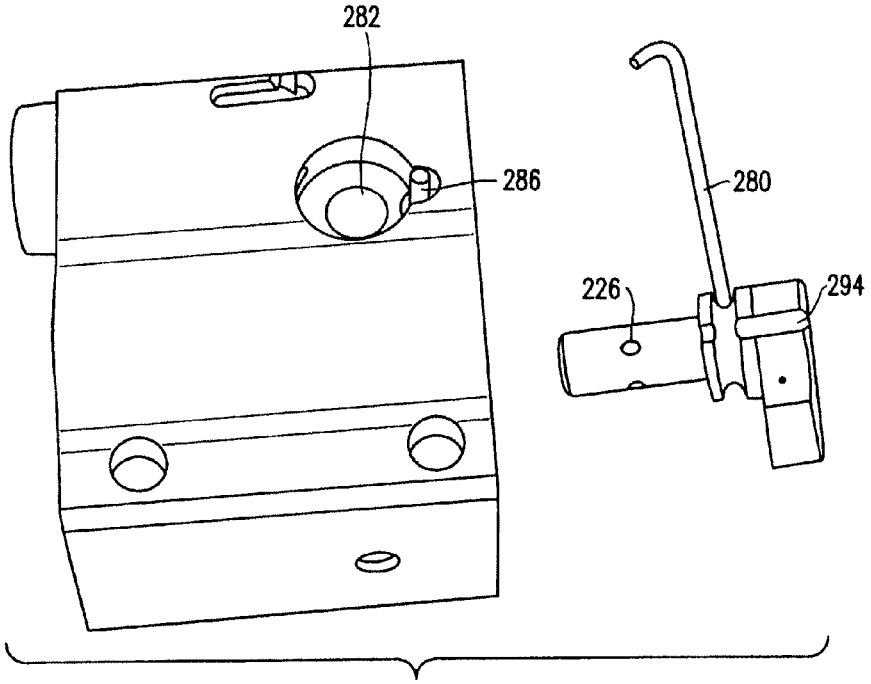
FIG. 27 is another exploded view of the gas block and selector of the piston assembly.

As described above, indirect gas operating system 60' has a gas block 202 having a cylinder 206 therein. Referring also to FIGS. 23 and 24, the gas block is shown in perspective. Gas block 202 is shaped to be mounted to the barrel assembly 24. Gas block 202 has a retaining clip or pin 280 provided to retain selector 214. Retaining clip 280 may be removed from block 202 to remove selector 214. Gas block 202 has recess 282 provided to accept selector 214. Recess 282 has portion 284 sized to house retaining and locating features 292 of selector 214. Gas block 202 further has detent pin 286 provided to locate and hold selector 214 in a selectable position. Gas block 202 further has bore 288 provided therein for locating and fastening to barrel 24 with suitable fasteners and fastening features. Referring also to FIGS. 25-27, intermediate regulator or selector 214 is shown. As noted before, selector 214 is rotatably mounted in block 202 where retaining feature 292 comprising, for example, a recess that cooperates with clip 280 whereby selector 214 is retained in housing 202 when clip 280 is in place. Selector 214 has orifices 226, 228 that may be of different size. In the embodiment shown, orifices 226, 228 are intersecting; in alternate embodiments, orifices 226, 228 may not be intersecting. In alternate embodiments, more or fewer orifices may be provided. Selector 214 has shaft 290 which engages in corresponding bore 282 of block 202 whereby gas is directed through ports in the selected orifice. Detent features 294, 296 are provided in selector 214 and cooperate with a spring loaded member, such as flexure 286, of block 202 to hold the selector in the desired position. Referring also to FIG. 28, barrel 24 has a bore 208, an exhaust port 212 disposed to communicate with the passage 240 in the gas block facing the barrel. Gas block 202 is fitted onto barrel 24 by appropriate fastening methods. Thus, gas block 202 has a cylinder 206 that houses piston 7' with the piston 7' engaging rod 6' that extends back to engage bolt assembly 64. The bolt carriage assembly 64 is provided within receiver 42 with the bolt assembly 64 having a striking or engagement surface that is engaged by the rear end of the operating rod. When a cartridge is fired, pressurized gas enters cylinder 206, displaces piston 7' and causes the striking rod 6' to strike the striking surface displacing the bolt assembly. A spring, similar to spring 5 in FIG. 13, is provided between shoulder 72' of rod 6' and guide 4 to bias rod 6' toward cylinder 202. Referring again to FIGS. 25-27, the user may select a desired cyclic rate with selector 214. Here, selector 214, which as noted before is rotatably mounted within block 202, is rotated to select the desired rate. The amount of gas flow and/or pressure that is exerted on the piston may be varied by the user when rotating selector 214. By rotating selector 214 to selectable positions, different charges or rates are applied to the piston by variable gas pressure, flow and selectable force. Exhaust port 218 may vent gas upon sufficient motion of piston 7', such as where front 220 of piston 7' passes port 224 of block 202 in communication with vent 218. In alternate embodiments, the selector could have a different shape or be in a different position. Throttling orifices 226, 228 in the selector may be sized for each to allow a different desired flow such as may be used with different particular charges or with different desired firing rates. This allows the user to have increased flexibility as to the firing rate, ammunition or charge used. Thus, by rotating the selector, the effective size of the port or orifice between bore 208 and cylinder 206 increased, decreased or eliminated allowing gas to blow through the orifice at a selectable variable rate, and throttling the amount and pressure or flow of gas applied to the piston. In alternate embodiments more or less holes or orifices may be provided. In the embodiment shown, exhaust gasses 218 are directed toward the muzzle of the firearm, away from the operator; in alternate embodiments, other directions or locations could be provided. In the embodiment shown, the gas block 202 and the piston 7' and rod assembly 6' fits within the hand guard assembly in a low profile relative to other block systems. The embodiment shown may employ a short barrel 24 with a shorter operating rod that results in higher impact loads to the bolt assembly.

Figure 29:
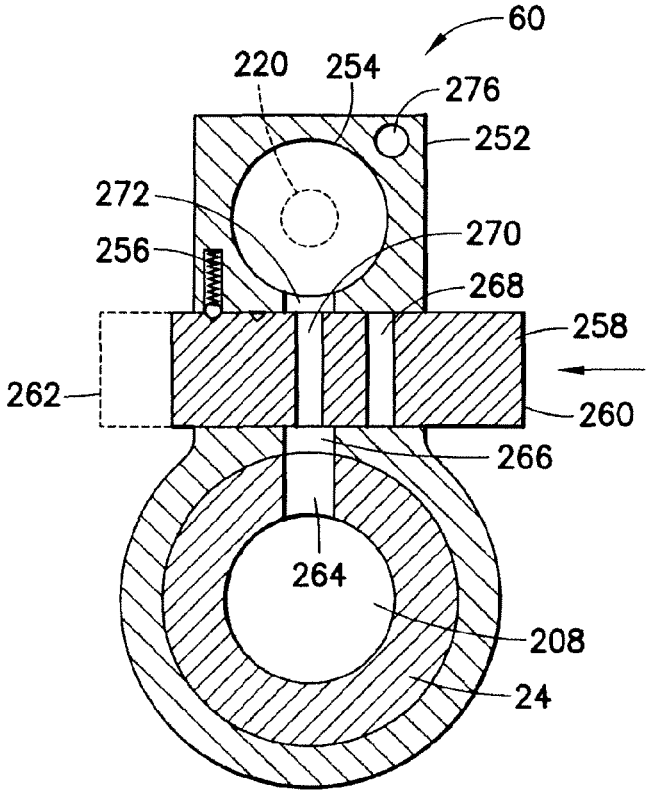
FIG. 29 is another section view of a gas piston assembly and firearm barrel.

Referring also to FIG. 29, there is shown a front cross section of a gas block section of an indirect gas operating system 60" in accordance with yet another embodiment. The gas block 252 in this embodiment has intermediate regulator 258 that slides rectilinearly within the gas block. In the embodiment shown, intermediate regulator 258 may be slidably selectable between two selectable positions 260, 262 corresponding to two different firing rates. When the intermediate regulator 258 is in first position 260, bore 208 is in communication with cylinder 254 and piston end 220 via passages 264, 266, throttling orifice 270 and passage 272. When the intermediate regulator 258 is in second position 262, bore 208 is in communication with cylinder 254 and piston end 220 via passages 264, 266 throttling orifice 268 and passage 272. Spring loaded detents 256 may be provided to allow intermediate regulator 258 to be retained in position 260 or 262 where a user may simply snap the regulator into either position by pushing on the opposing end. In this manner, the firing rate may be changed without the use of tools in the field. Exhaust vent 276 may be provided to vent gas' when the piston extends to a predetermined location. In alternate embodiments, more or less positions or orifices may be provided, for example a third or fourth position where a different orifice size or no orifice is present.

Figure 32A:
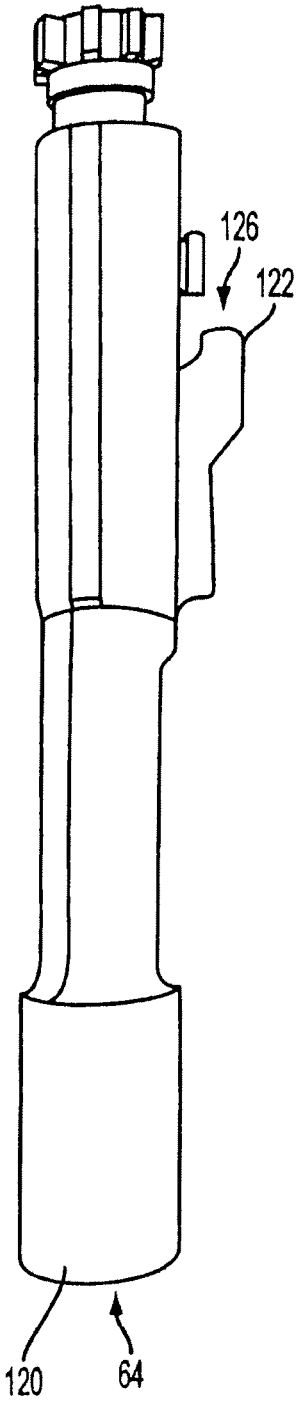
FIG. 32A is an elevation view of a bolt carriage assembly and FIG. 32B is an elevation view of a conventional bolt carriage.
Figure 32B:
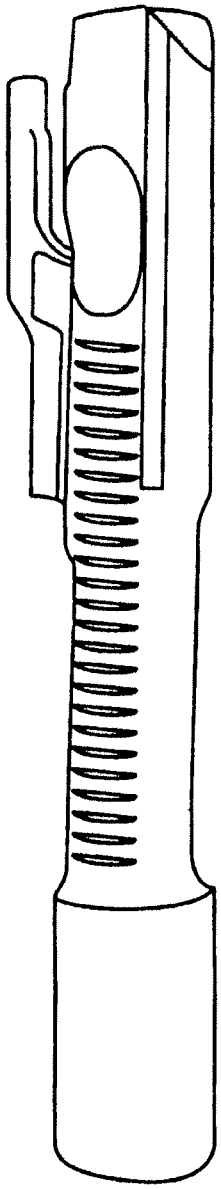
FIG.32B PRIOR ART
Figure 33:
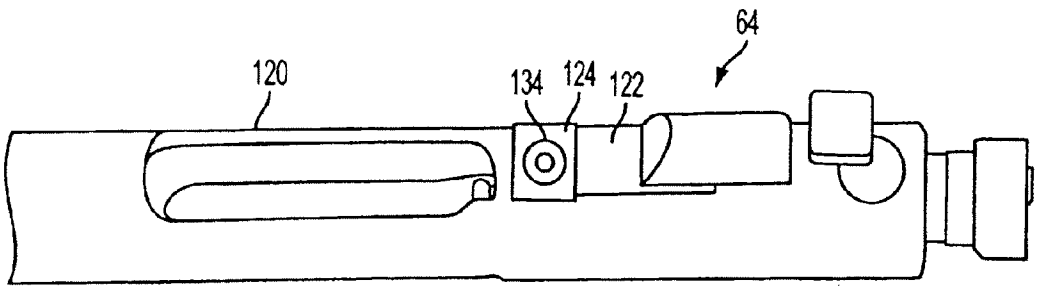
FIGS. 33 and 33A-33B are respectively a perspective view and different exploded views of the bolt carriage assembly.
Figure 33A:
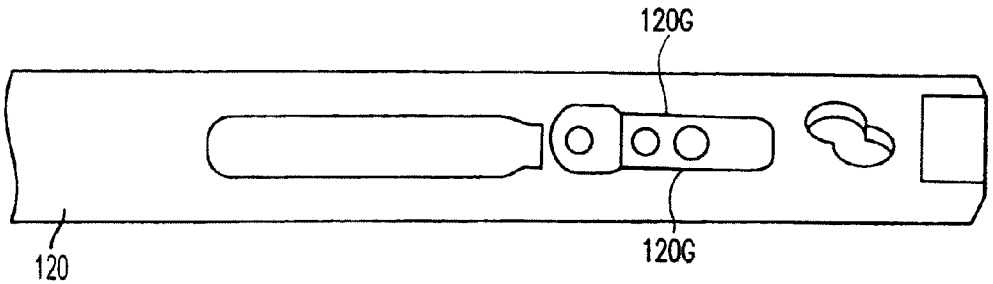
Figure 34:
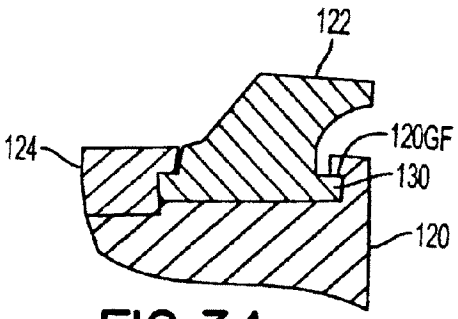
FIG. 34 is a section view of a portion of the bolt carriage assembly.
Figure 33B:
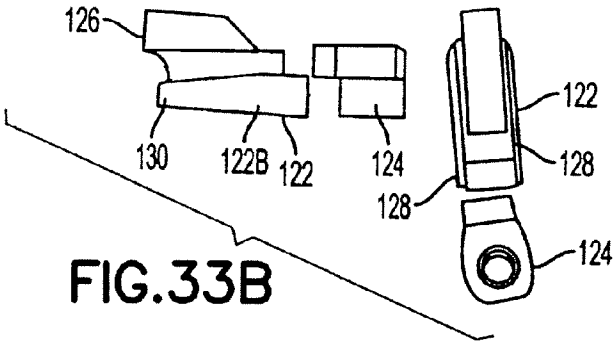

Referring now to FIG. 32A, there is shown a view of a bolt carriage assembly 64 of the firearm shown in FIG. 1 in accordance with an exemplary embodiment. Referring also to FIGS. 33-34, there is shown an exploded view of a bolt assembly of the firearm shown in FIG. 1. The embodiment shown may employ a short barrel 24 with a shorter operating rod 6 that results in higher impact loads to the bolt carriage assembly. As a result, the bolt carriage assembly 64 is subjected to such higher impact and operating loads. In FIG. 32B, the assembly is a conventional (M4) direct gas operated bolt carriage assembly. Bolt carriage assembly 64 has a bolt carriage frame or carrier 120, a strike portion or key assembly 122 and a stop member 124. Strike portion 122 is struck by rod 6 (or rod 6') at face or portion 126. As seen in FIG. 13 strike face 126 is located to be substantially coaxial with the operating rod 6. The strike portion 126 is suitably shaped (e.g. tapered) to direct loads imparted by rod 6 into the base 122B that engages the strike portion 122 to the carrier frame. Strike portion 122 has a keyed portion 128 on base 122B that engages corresponding keyed lateral grooves 120G in frame 120 that form a generally T-shaped keyway. Additionally a front notch engagement portion 130 may be provided in the base 122B of strike portion 122 to engage a corresponding front key groove 120GF in carrier 120. The keys 128 on the base of the strike portion 122 are sized to form a press or force fit with the keyways 120B, 120GF of the carrier frame. Upon pressing strike portion 122 into its corresponding grooves of carrier 120, stop piece 124 is fastened to carrier 120 using fastener 134 to further retain strike portion 122. Stop piece 124 has a lock step engaging the end of the strike 122. In alternate embodiments, the key ways could be provided within the strike portion and a corresponding interface on the carrier. In this manner, the bolt assembly 64 may withstand higher impact and operating loads.

Figure 35:
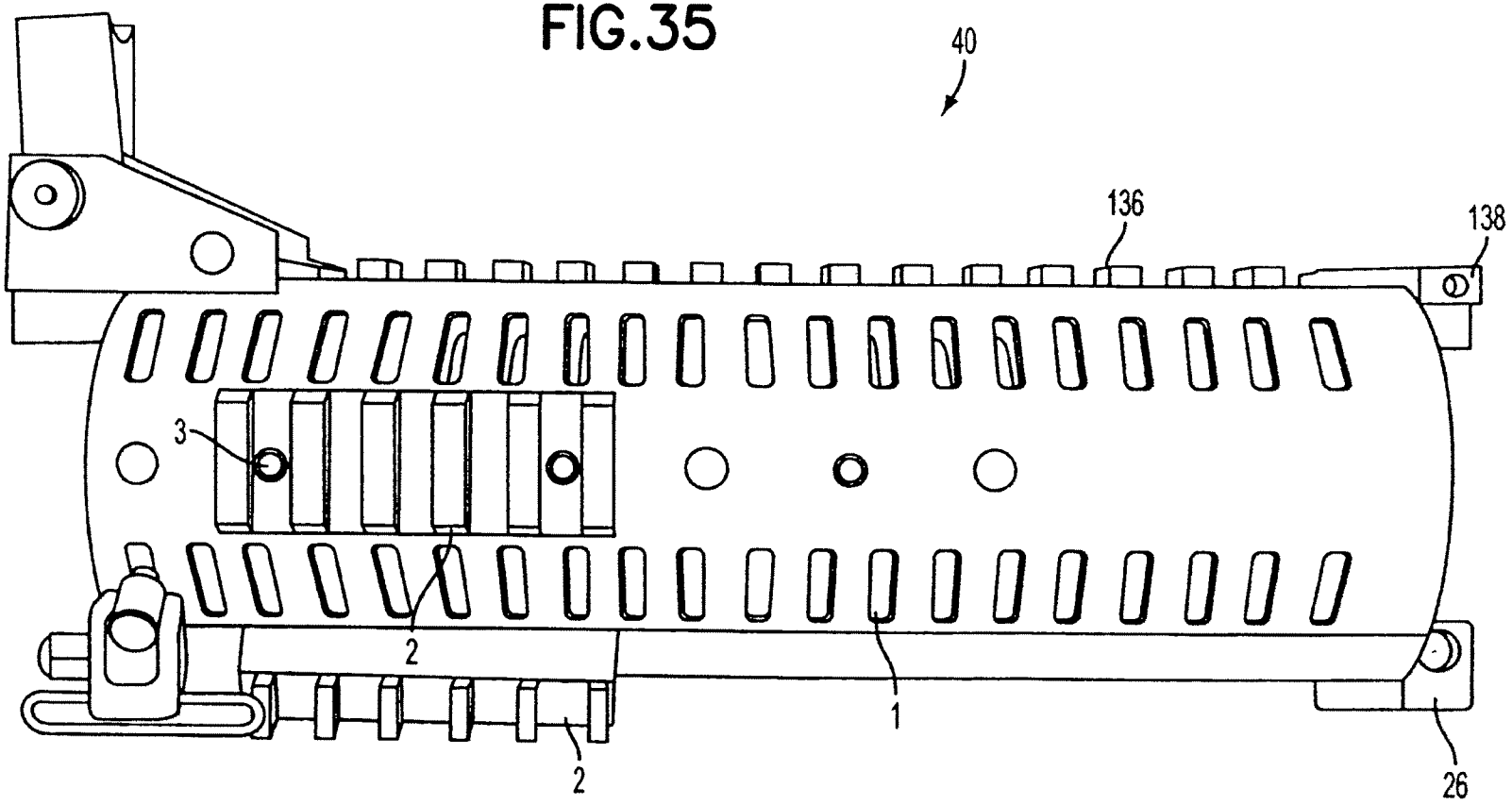
FIG. 35 is a side elevation view of a hand guard assembly of the firearm in accordance with an exemplary embodiment.
Figure 36:
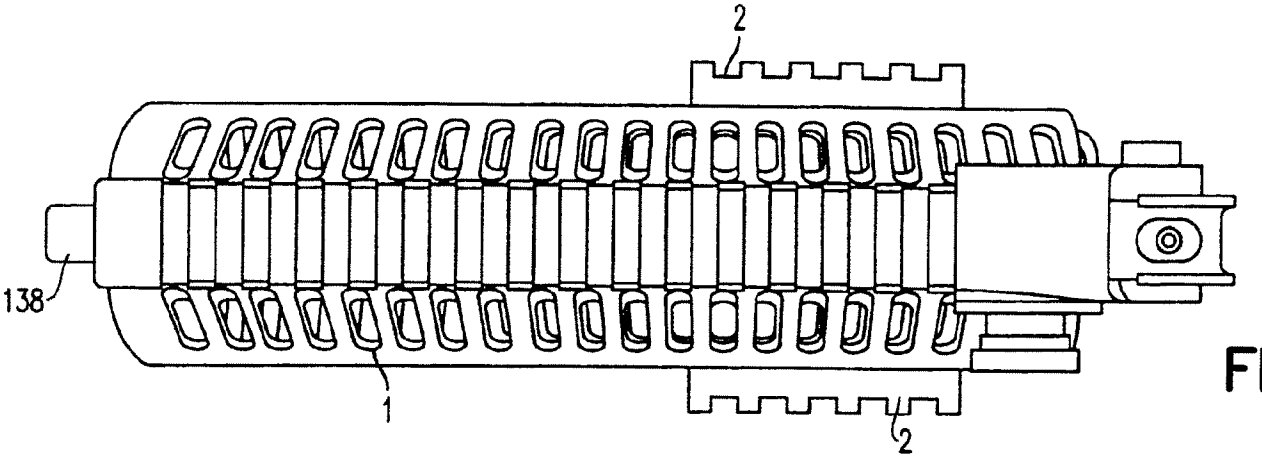
FIG. 36 is a top plan view of the hand guard assembly in FIG. 35.
Figure 37:
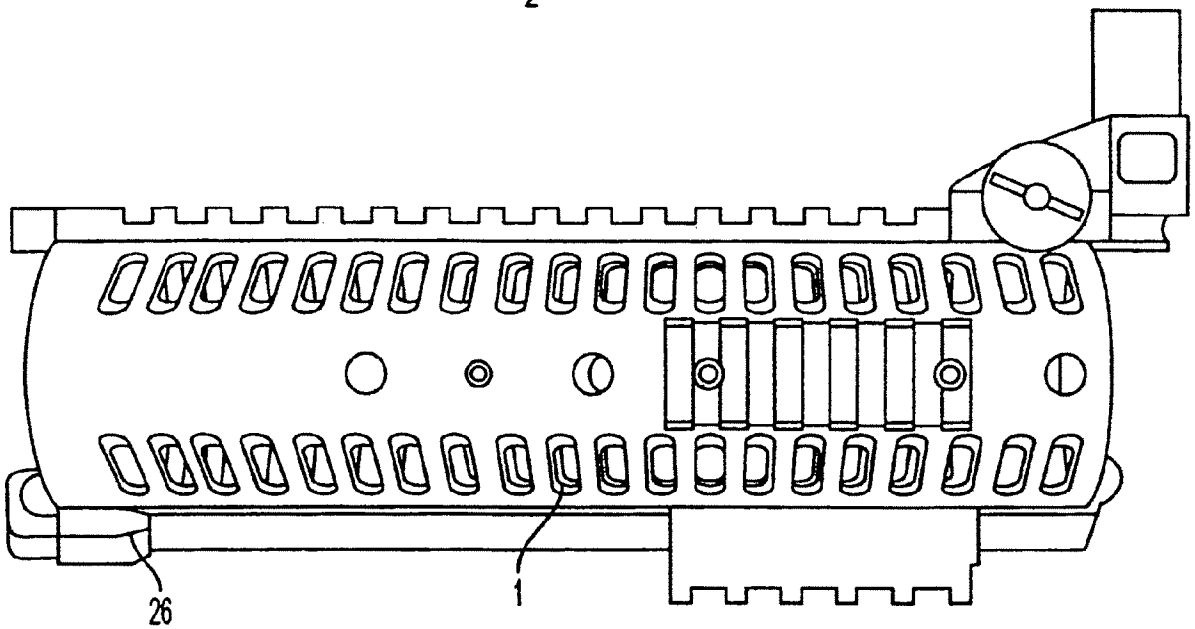
FIG. 37 is another side elevation view of the hand guard assembly.
Figure 38:
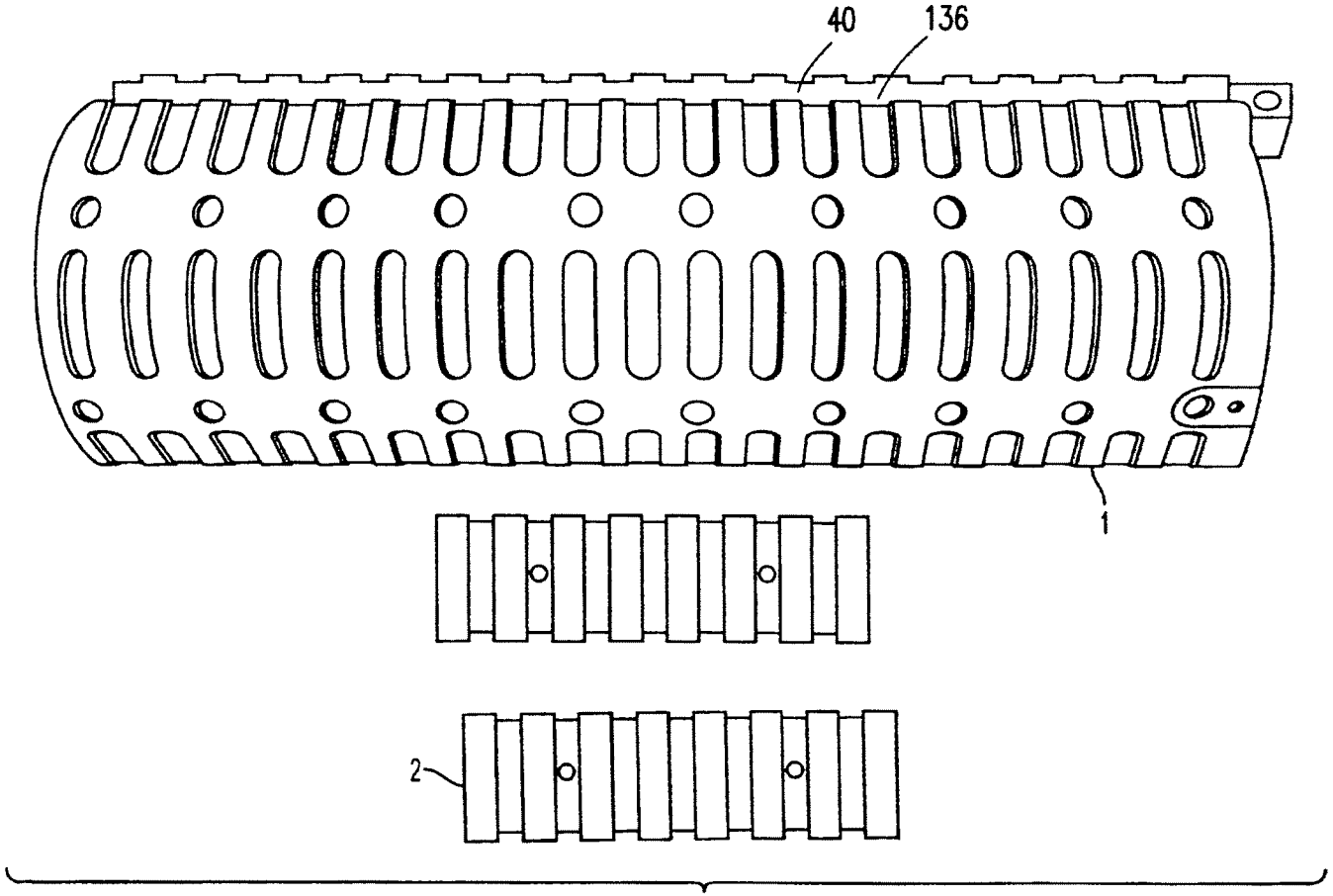
FIG. 38 is a side elevation view of the hand guard and removed rails.
Figure 39:
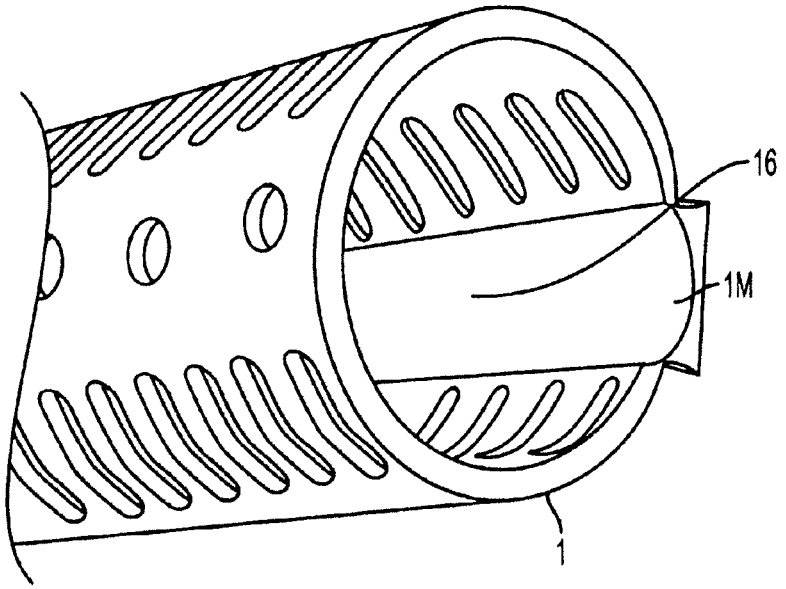
FIG. 39 is an isometric view of a front end of the hand guard.

Referring now to FIG. 35, there is shown a side elevation view of a hand guard assembly 40 of the firearm shown in FIG. 1. Referring also to FIG. 36, there is shown a top elevation view of a hand guard assembly 40 of the firearm shown in FIG. 1. Referring also to FIG. 37, there is shown a side elevation view of a hand guard assembly 40 of the firearm shown in FIG. 1. Referring also to FIG. 38, there is shown a side elevation view of a hand guard 1 and removed relocatable rails of the firearm shown in FIG. 1. Referring also to FIG. 39, there is shown an isometric view of a front end of hand guard 1 of the firearm shown in FIG. 1. Hand guard 40 has an aluminum shell 1 that in this embodiment is of unitary construction and has vent holes and external ribbing. Hand guard 40 is ergonomically sized to allow a user to comfortably grip the guard. Shell 1 is mounted to the receiver 42 and is floating relative to barrel 24 and barrel radiator 102. In alternate embodiments, multiple shells, inner ribbing, heat shields or double heat shields and liners to facilitate cooling of the barrel 14 while keeping hand guard 40 at a temperature sufficiently low for an operator could be provided. Removable and relocatable rails 2, 136 may be provided on hand guard 40 and may be permanently mounted or removably mounted and be removable or moveable to different locations on hand guard 40. The rails and mounting system to the hand guard may be substantially similar to rails described in U.S. patent application Ser. No. 11/113,525 filed Apr. 25, 2005, which is incorporated by reference herein in its entirety. In alternate embodiments, rails 2, 136 may be in different locations with different sizes. In this embodiment, the guard mount to the receiver has an upper lug 138 that is provided to interface and mount to a corresponding slot 140 in the frame of the upper rail of upper receiver 42 (see FIG. 31). Removable bottom lug 26 is provided to engage a corresponding slot or clevis 142 (see FIG. 30) machined into the standard front bottom lug attachment of the lower and upper receiver 42. In this manner, the rear of guard 1 has a lug 26 recessed into the bottom clevis 142. In this manner, guard 1, via lug 26 is locked to lower receiver 144 and upper receiver 42 with the same pin 146 (see FIG. 13) and guard 1 is further locked to upper receiver via lug 138 and pin 27 (see FIG. 13).

Figure 30B:
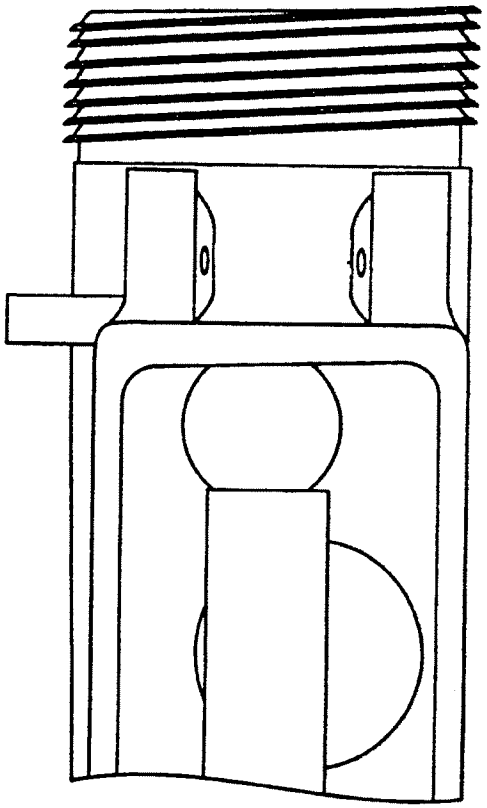
FIG.30B PRIOR ART
FIG. 30A is a bottom view of a receiver assembly in accordance with an exemplary embodiment and FIG. 30B is a bottom view of a conventional recess assembly.
Figure 30A:
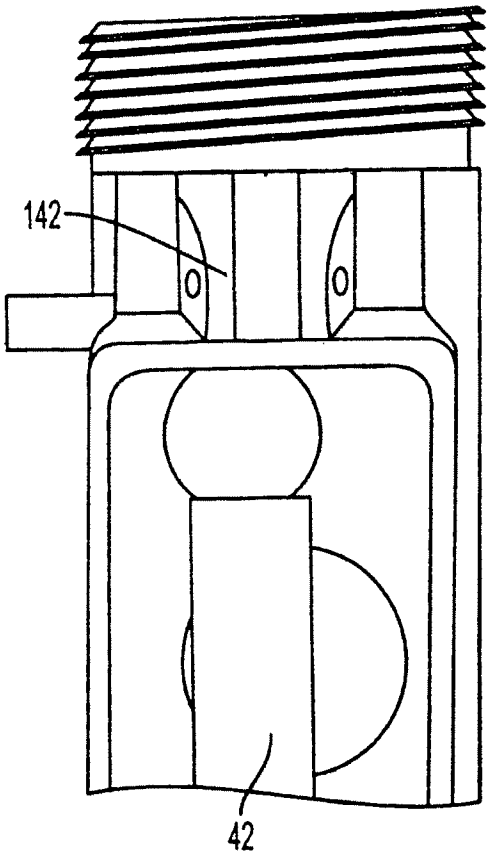
Figure 31A:
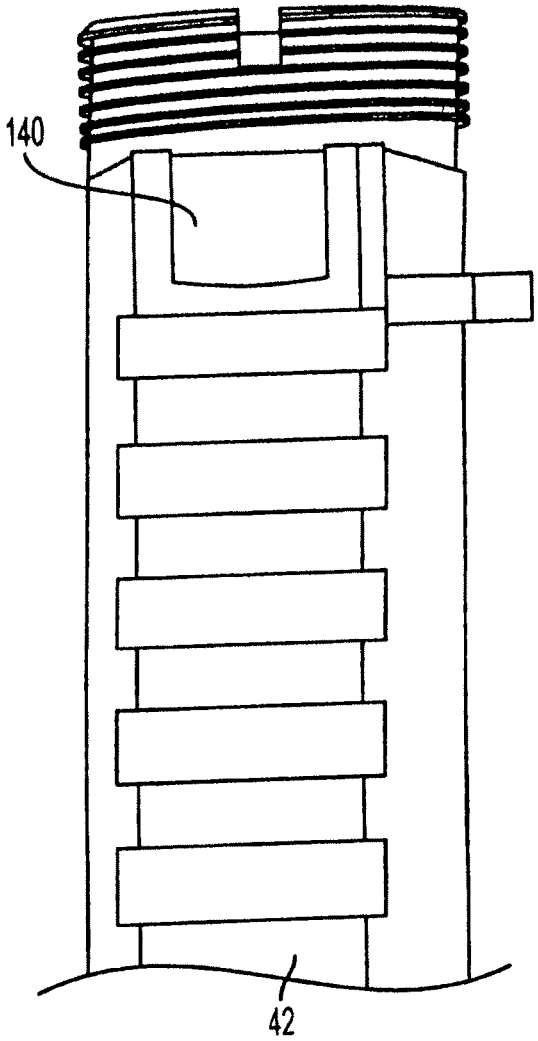
FIG. 31A is a top view of the receiver assembly and FIG. 31B is a top view of a conventional receiver assembly.
Figure 31B:
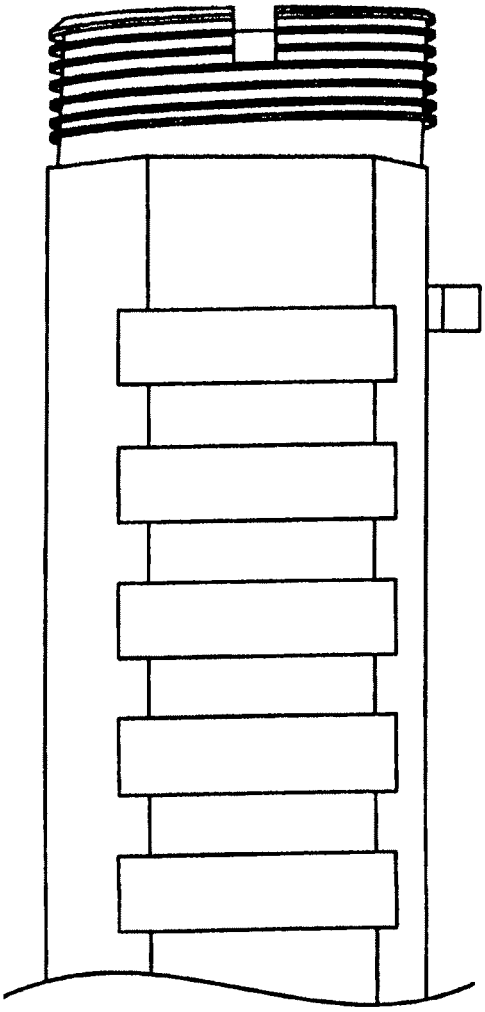
FIG.31B PRIOR ART

Referring now to FIG. 30A, there is shown a bottom view of a receiver assembly 42 of the firearm shown in FIG. 1. Referring also to FIG. 31A, there is shown a top view of a receiver 42 of the firearm shown in FIG. 1. In FIG. 30B, 31B are respective bottom and top views of a conventional M4 receiver as shown for example purposes. As shown in FIG. 31A, slot 140 in the frame of the upper rail of upper receiver 42 is provided to interface and mount corresponding lug 138 of hand guard 1. As shown in FIG. 30A, slot or clevis 142 is machined into the front bottom lug, that forms the attachment of the lower and upper receivers, to engage the corresponding removable lower lug 26 of hand guard 40. Hence, the rear of guard 1 has a lug 26 recessed into the bottom clevis 142. Thus as shown in FIG. 1 and as may be realized from FIG. 13, when mounted, guard 1 is locked via lug 26 to lower receiver 144 and upper receiver 42 with the pin 146 connecting the lower and upper receivers to each other and guard 1 is further locked to upper receiver via lug 138 and pin 27 (see FIG. 8). As seen in FIG. 1, and as noted before, when mounted, the hand guard 1 covers the indirect gas operating system 60. The gas block 8 (or gas block 202, 252) is housed inside the guard 1. This is facilitated by the low profile of the gas block. As seen in FIG. 39, the guard may include an inner groove 1G or channel in which the gas operating system 60 is disposed. The channel provides sufficient clearance around the gas operating system 60 for unencumbered operation. Claim 1G may have a flared or widened portion 1M in way of the gas block.

Figure 40:
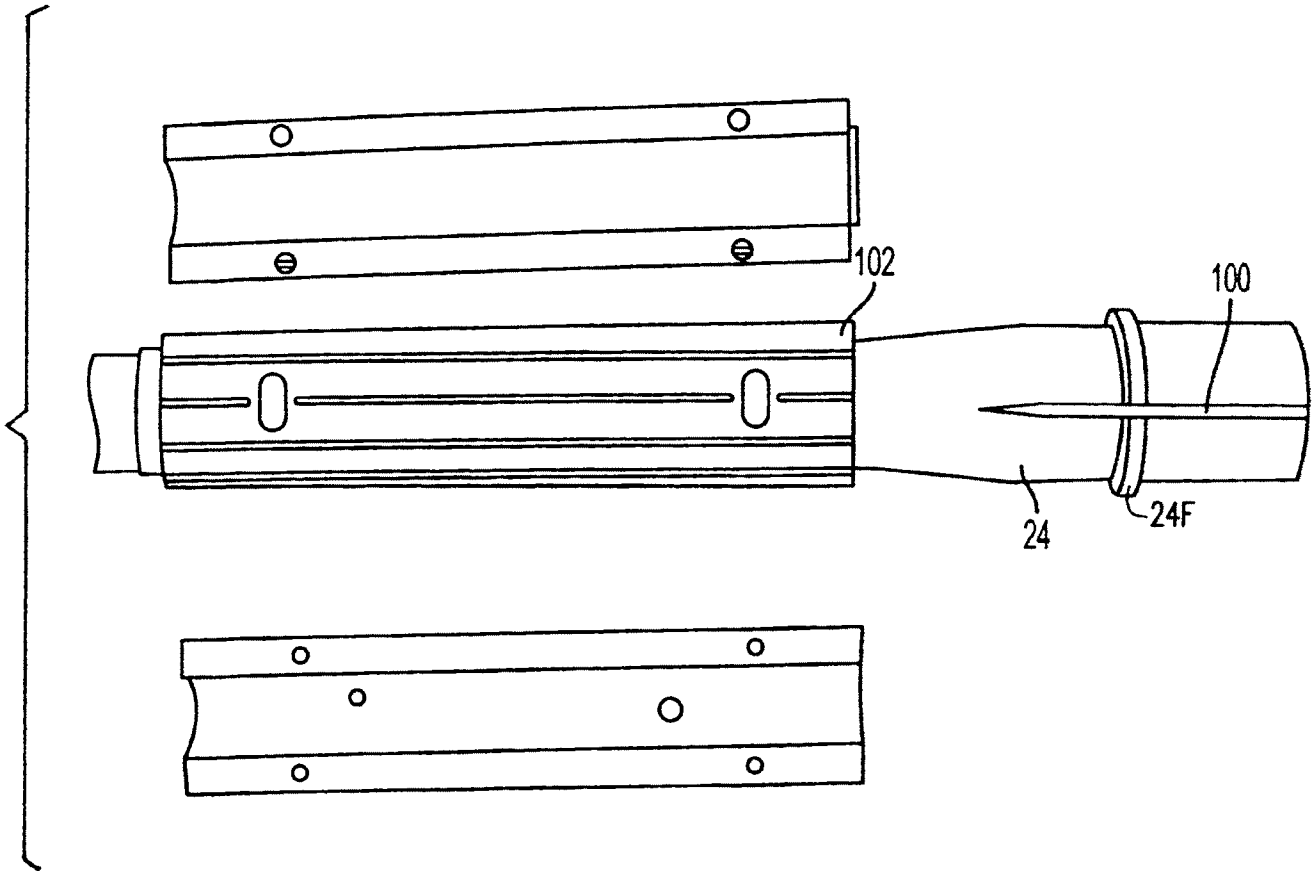
FIG. 40 is an elevation view of the barrel of the firearm and radiator assembly in accordance with another exemplary embodiment, the radiator being shown in assembled and disassembled conditions.

Firearm 30 may have a forced air cooling system as will be described in accordance with another exemplary embodiment. As seen in FIG. 40, radial air grooves 100 are provided on barrel 24 that extend into the receiver section. The air grooves 100 are part of the forced air cooling system that utilizes the motion of the bolt and bolt carriage assembly to pump cool air along the barrel and through hand guard assembly (e.g. guard 1) which houses a radiator element 102 that surrounds a reduced diameter portion of the barrel 24. Air is forced from the receiver by the bolt assembly, through the barrel retaining nut 106 via grooves 100 into and around the radiator and out cooling holes or slots in the hand guard. In alternate embodiments, the cooling system may be employed on alternate firearm types.

Figure 41:
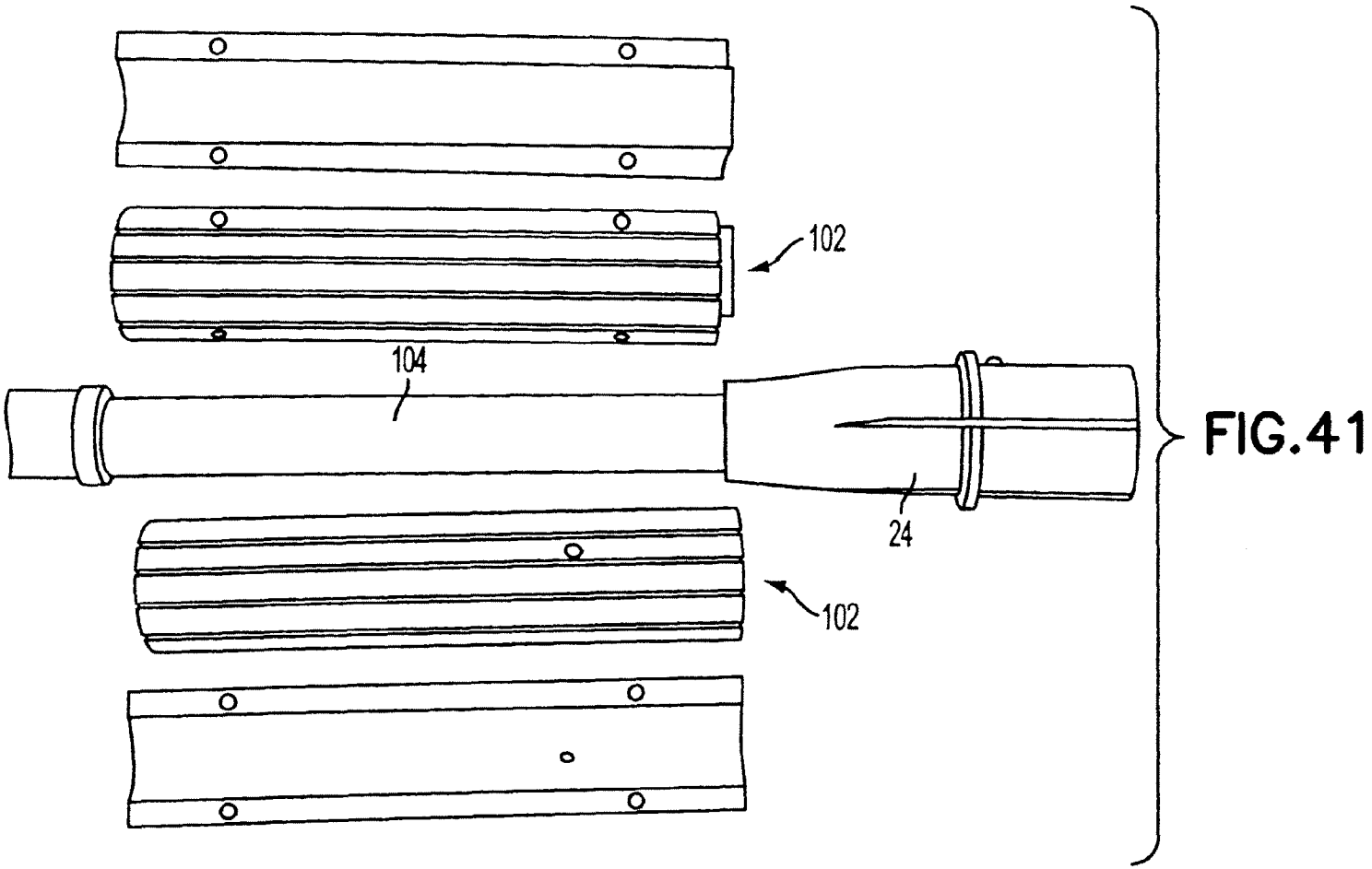
FIG. 41 is an elevation view of the barrel and radiator assembly where the radiator assembly is removed from the barrel, the radiator assembly portions being positioned to show outer and inner surfaces.

Referring still to FIG. 40, there is shown an elevation view of a barrel and radiator assembly of the firearm shown in FIG. 1. Referring also to FIG. 41, there is shown an elevation view of a barrel and radiator assembly where the radiator 102 is removed from the barrel 24 of the firearm shown in FIG. 1. As noted before, air grooves 100 are provided on the flared outer portion of barrel 24 that extend into the air flow within the receiver section. When mounted to the receiver 42, the grooves 100 form channels between the surface of the barrel nut 23 (mounting the barrel to the receiver) and barrel (see also FIG. 10). As seen in FIG. 40, grooves 100 extend through barrel retention flange 24F. The air flow channels on the barrel are aligned to direct flow towards and over the radiator 102 on the barrel 20. In this embodiment, radiator 102 is an assembly of two substantially similar parts. Each portion has a generally semicircular cross-section with an inner diameter sized to provide desired thermal conductive contact with the undercut section 104 of the barrel. The radiator is made of aluminum or any other desired material with good heat conduction properties. The outer surface of each radiator section has suitable radiator fins formed therein. In this embodiment, the radiator fins are longitudinally aligned. As may be realized from FIG. 10, air is forced from the receiver by the bolt assembly, through the grooves in the barrel, and directed over the fins of radiator 102. Cooling holes or slots in the hand guard further aid convection cooling. In alternate embodiments, the cooling system may be employed on alternate firearm types. Portions of radiator 102 may be fastened together, by screws as an example. Radiator 102 may have fins or multiple panels or surfaces. In alternate embodiments, the size, shape or number of fins of radiator 102 may be varied. In this embodiment a Bottom shield 112 (see FIG. 10) may be removably mounted to radiator 102 to protect the hand of the user grasping the guard. The shield may be of any desired size and shape. The shield may be made of sheet metal curved to conform generally to the inside of guard 1. Radiator 102 may be keyed or otherwise fastened to barrel 24 to maintain orientation of the shield 112 or radiator 102. As seen in FIG. 10 heat shield 112, in this embodiment may be is fastened to the lower portion of the radiator to shield the operator's hand, on the hand guard from heat dissipated from the barrel and radiator. The shield may be suitably fastened to the radiator and is located to provide an air gap with the radiator element.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An automatic or semi-automatic firearm having an indirect gas operating system, the firearm comprising:

a receiver;

a bolt assembly slidably received within the receiver;

a barrel having a bore, the barrel coupled to the receiver;

a gas block mounted to the barrel, the gas block having a cylinder completely defined within the gas block and in fluid communication with the bore;

a piston slidably received within the cylinder;

a rod coupled to the piston and having a striking rod; wherein gas discharged from a fired cartridge displaces the rod and causes the striking rod to strike a striking surface of the bolt assembly, wherein the gas repositions the bolt assembly in the receiver.

2. The firearm of claim 1, wherein the striking rod and the bolt assembly disengage each other after the striking rod strikes the bolt assembly.

3. The firearm of claim 1, wherein the gas block comprises a front sight frame having.

4. The firearm of claim 1 further comprising a hand guard assembly coupled to the receiver and surrounding at least a portion of the barrel, wherein the hand guard assembly further comprises a plurality of removable accessory rails.

5. The firearm of claim 4, wherein the hand guard assembly is a one piece member of unitary construction.

6. The automatic or semi-automatic firearm as in claim 1, wherein the gas block is a monolithic structure extending upwardly from the barrel.

7. The automatic or semi-automatic firearm as in claim 6, wherein the gas block further comprises a regulator movably mounted thereto for movement between at least a first position and a second position, wherein gas flow from the barrel is varied as the regulator moves between the first position and the second position.

8. An automatic or semi-automatic firearm having an indirect gas operating system comprising:

a receiver;

a bolt assembly slidably received within the receiver;

a barrel having a bore, the barrel being coupled to the receiver;

a front sight frame having an integral cylinder completely formed within the sight frame, the front sight frame being secured to barrel and wherein the integral cylinder is in fluid communication with the bore;

a front folding sight movably coupled to the front sight frame; and a piston assembly having a piston end and a striking end, a portion of the piston assembly being slidably received within the cylinder; wherein gas discharged from a fired cartridge displaces the portion of the piston assembly received in the cylinder and causes the striking end to contact and move the bolt assembly within the receiver.

9. The firearm of claim 8, wherein the striking end and the bolt assembly disengage each other after the striking end strikes the bolt assembly.

10. The firearm of claim 8 further comprising a hand guard assembly coupled to the receiver and surrounding at least a portion of the barrel wherein the hand guard assembly further comprises a plurality of removable accessory rails.

11. The firearm of claim 10, wherein the hand guard assembly and the receiver are of one piece unitary construction.

12. The firearm of claim 8, wherein the bolt assembly has a removable striking surface, and wherein the piston assembly comprises a separable piston and striking rod, and wherein the piston is spring loaded into the cylinder via a spring force exerted by the striking rod.

13. The automatic or semi-automatic firearm as in claim 8, wherein the gas block is a monolithic structure extending upwardly from the barrel.

14. An automatic or semi-automatic firearm having an indirect gas operating system, the firearm comprising:

a receiver;

a bolt assembly slidably received within the receiver;

a barrel having a bore, the barrel coupled to the receiver;

a hand guard assembly coupled to the receiver and surrounding at least a portion of the barrel;

at least one accessory rail removably secured to the hand guard assembly;

a gas block fitted to the barrel, the gas block completely defining a cylinder within the gas block; and a rod assembly having a portion slidably received within the cylinder of the gas block; and wherein gas discharged from a fired cartridge displaces the rod assembly and causes a striking rod of the rod assembly to strike and displace the bolt assembly.

15. The firearm of claim 14, wherein the striking rod and the bolt assembly disengage each other after the striking end strikes the bolt assembly.

16. The firearm of claim 14, wherein the gas block further comprises a front sight frame having a moveable front sight.

17. The firearm of claim 14, wherein the hand guard assembly is a one piece member of unitary construction.

18. The firearm of claim 17, wherein the bolt assembly has a removable striking surface, and wherein the rod assembly comprises a separable piston and striking rod, and wherein the separable piston is spring loaded into the cylinder via a spring force exerted by the striking rod.

19. The automatic or semi-automatic firearm as in claim 14, wherein the gas block is a monolithic structure extending upwardly from the barrel and wherein the gas block further comprises a regulator movably mounted thereto for movement between at least a first position and a second position, wherein gas flow from the barrel is varied as the regulator moves between the first position and the second position.

20. An automatic or semi-automatic firearm having an indirect gas operating system, comprising:

a bolt assembly having a striking surface, the bolt assembly slidably received within a receiver;

a barrel having a bore, the barrel coupled to the receiver;

a gas block having a cylinder completely defined within the gas block, the gas block being secured to the barrel, wherein the cylinder is in fluid communication with the bore; and an operating rod assembly having a piston interface end and a striking end, the piston interface end being actuatably coupled to the cylinder; wherein, gas discharged from a fired cartridge pressurizes the cylinder displacing the piston interface end and causes the striking end to strike the striking surface displacing the bolt assembly, and wherein the striking end and the striking surface disengage each other after the striking end strikes the striking surface.

21. The automatic or semi-automatic firearm as in claim 20, wherein gas block is a monolithic structure extending upwardly from the barrel.

* * * * *